US005278025A

United States Patent [19]

Okamura et al.

[11] Patent Number: 5,278,025

[45] Date of Patent: Jan. 11, 1994

[54] METHOD FOR FORMING IMAGES

[75] Inventors: Hisashi Okamura; Kazunobu Katoh; Tetsuro Kojima, all of Kanagawa, Japan

[73] Assignee: Fuji Photo Film Co., Ltd., Kanagawa, Japan

[21] Appl. No.: 931,508

[22] Filed: Aug. 21, 1992

Related U.S. Application Data

[63] Continuation of Ser. No. 524,103, May 16, 1990, abandoned.

[30] Foreign Application Priority Data

May 17, 1989 [JP] Japan ..... 1-123694

[51] Int. Cl.[5] ..... G03C 5/26; G03C 5/30

[52] U.S. Cl. ..... 430/264; 430/219; 430/265; 430/487; 430/544; 430/598; 430/957

[58] Field of Search ..... 430/264, 223, 487, 598, 430/957, 265

[56] References Cited

U.S. PATENT DOCUMENTS

| | | | |
|---|---|---|---|
| 4,269,929 | 5/1981 | Nothnagle | 430/264 |
| 4,332,878 | 6/1982 | Akimura et al. | 430/443 |
| 4,684,604 | 8/1987 | Harder | 430/223 |
| 4,740,452 | 4/1988 | Okutsu et al. | 430/265 |
| 4,756,997 | 7/1988 | Marchesano | 430/264 |
| 4,770,990 | 9/1988 | Nakamura et al. | 430/223 |
| 4,863,830 | 9/1989 | Okutsu et al. | 430/264 |
| 4,877,723 | 10/1989 | Hirano et al. | 430/410 |
| 4,880,727 | 11/1989 | Inoue et al. | 430/940 |
| 4,948,712 | 8/1990 | Inoue et al. | 430/409 |
| 4,952,483 | 8/1990 | Inoue et al. | 430/410 |
| 4,975,354 | 12/1990 | Machonkin et al. | 430/264 |
| 4,988,604 | 1/1991 | Machonkin et al. | 430/264 |
| 5,039,591 | 8/1991 | Okutsu et al. | 430/264 |
| 5,085,971 | 2/1992 | Katoh et al. | 430/264 |
| 5,134,055 | 7/1992 | Okamura et al. | 430/264 |
| 5,145,765 | 9/1992 | Okamura et al. | 430/264 |
| 5,147,754 | 9/1992 | Okamura et al. | 430/264 |
| 5,187,042 | 2/1993 | Katoh | 430/264 |

FOREIGN PATENT DOCUMENTS

| | | | |
|---|---|---|---|
| 89738 | 7/1981 | Japan | 430/265 |
| 211647 | 9/1987 | Japan . | |

OTHER PUBLICATIONS

Chem. Abst. 108: 158976f, 1988; Abstr. of Japanese Kokai 62/211,647, Sep. 1987, Kojima et al.

*Primary Examiner*—Richard L. Schilling

*Attorney, Agent, or Firm*—Sughrue Mion Zinn Macpeak & Seas

[57] ABSTRACT

A method for forming an image comprising the steps of: (a) imagewise exposing silver halide photographic materials; where said photographic material contains (1) a compound represented by formula (I)

(I)

wherein $R_1$ represents an aliphatic group or an aromatic group; $R_2$ represents a hydrogen atom, an alkyl group, or an aryl group, an alkoxy group, an aryloxy group, an amino group, a carbamoyl group, or an oxycarbonyl group; $G_1$ represents a carbonyl group, a sulfonyl group, a sulfoxy group, or an iminomethylene group; and $A_1$ and $A_2$ both represent a hydrogen atom, or one of $A_1$ or $A_2$ represents a hydrogen atom and the other represents a substituted or unsubstituted alkylsulfonyl group, a substituted or unsubstituted arylsulfonyl group, or a substituted or unsubstituted acyl group, and (2) a redox compound that can release a development inhibitor when oxidized; and (b) subjecting said imagewise exposed silver halide photographic materials to development-processing where a bath used in said development-processing contains a nucleation development accelerator.

3 Claims, 1 Drawing Sheet

METHOD FOR FORMING IMAGES

This is a continuation of application Ser. No. 07/524,103 filed May 16, 1990, now abandoned.

FIELD OF THE INVENTION

This invention relates to a silver halide photographic material and, more particularly, to a silver halide photographic material which can provide a negative image with high contrast, a negative image with high photographic density, and excellent halftone image quality.

BACKGROUND OF THE INVENTION

The field of photomechanical process, demands photographic materials that give excellent reproducibility of originals, are processable with stable processing solutions that are simple to replenish, and so on in order to cope with the diversity and complexity of printed matter.

In particular, a line original used in the photograph-taking process is made by putting together photocomposed letters, handwritten letters, illustrations, halftone photographs, and so on, so it has a mixture of images differing in density and line width from one another. Under such a situation, it has been strongly desired to develop such process cameras, photographic light-sensitive materials and image forming methods as to duplicate line originals with good reproducibility.

In the photomechanical process for catalogues and large-sized posters, on the other hand, magnification (spread) or reduction (choke) of halftone photographs is normally carried out. In the case of magnification, lines are sparsely present in the photomechanical process using expanded dots, and photographs of blurred dots are taken. In the case of the reduction, the number of lines per inch becomes greater than those of the originals, so halftone photographs of the smaller dot areas are taken. Accordingly, image forming methods which can ensure much wider latitude than conventional ones have been required for retaining the reproducibility of screen range.

As for the light source of a process camera, a halogen lamp or a xenon lamp is used. For the purpose of gaining photograph-taking sensitivity of these light sources, photographic light-sensitive materials are generally subjected to orthochromatic sensitization. However, it has turned out that orthochromatically sensitized photographic materials are more strongly influenced by the chromatic aberration of the lens used, which results in a deterioration in quality of the images formed. This kind of deterioration is more conspicuous when a xenon lamp is used as light source.

A system that has been known to meet the demand for wide latitude, uses a lithographic silver halide photosensitive material comprising silver chlorobromide (having a chloride content of at least 50%) processed with a hydroquinone developer in which the effective concentration of sulfite ion is extremely low. This results in a line or dot image with high enough contrast and high enough photographic density to clearly distinguish the image area from the non-image area. In this system, however, the developer used is quite sensitive to air oxidation because of a low sulfite ion concentration. Various efforts and contrivances have been made to maintain the developer activity constant. In the present situation, some of them, though practically used, have a very slow processing speed which results in the lowering of working efficiency.

Thus, there is a need for image forming systems which can resolve the instability of image formation in the above-described developing method (lithographic developing system) by using a processing solution with a high storage stability upon development and can provide very high contrast photographic characteristics. One such system has been proposed using silver halide photographic material having high surface sensitivity, but low internal sensitivity, and containing a specified acylhydrazine compound as an additive. This material is processed with a developer which contains a sulfite preservative in a concentration of at least 0.15 mol/l and is adjusted to pH 11.0 to 12.3 to produce a very high contrast negative image with a gamma value greater than 10. This material is disclosed in U.S. Pat. Nos. 4,166,742; 4,168,977; 4,221,857; 4,224,401; 4,243,739; 4,272,606; and 4,311,781. This image-forming system can use silver iodobromide and silver chloroiodobromide in addition to silver chlorobromide. This is in contrast to the conventional system for forming a very high contrast image where only silver chlorobromide with a high chloride content is used.

The foregoing image forming system has excellent properties with respect to sharpness, quality of halftone image, stability and rapidity of processing, and reproducibility of the original. But systems that yield further improvement of the reproducibility of an original are desired in order to cope with the up-to-date diversity of printed matter.

For gathering and contact works improvement has been directed to increasing work efficiency by developing material that can be used in a better-lighted environment than previously known. This aim has led to the development of photosensitive materials and exposure printers for graphic arts which can be handled in an environment that is substantially "daylight".

The term daylight photosensitive material as used herein describes a photosensitive material of the kind which can be handled safely for a long period of time using a safe-light with rays not including the ultraviolet wavelengths of 400 nm or longer.

Daylight photosensitive material to be employed in gathering and contact works is utilized for effecting negative-positive conversion or positive-positive conversion by using as originals development-processed films having letter or halftone images, and subjecting the originals and a contact photosensitive material to contact exposure. In addition, it has been required that this daylight photosensitive material have (1) properties making it feasible for halftone, line and letter images to undergo negative image-positive image conversion in accordance with individual dot areas, line widths and letter image widths, respectively, and (2) properties permitting the tone control of halftone images, and the line width control of line and letter images. Daylight contact photosensitive materials capable of meeting these requirements have been available.

However, in high level image-conversion work for forming white on-black letter images by superimposition contact work, the conventional method of using a daylight photosensitive material and carrying out the contact work in daylight was defective. This conventional method gave white-on-black letter images inferior in quality to those provided by using a conventional dark-room contact photosensitive material and carrying out the contact work in dark room.

The method of forming white-on black letter image through the superimposition contact work is described in more detail below.

As shown in FIG. 1 hereinafter, a letter or line image-formed film (line original) (b) stuck to a transparent or translucent base (a); and a halftone image-formed film (halftone original) (d) stuck to a transparent or translucent base (c), (wherein a polyethylene terephthalate film having a thickness of about 100 microns is generally used as the sticking base) are superposed, and employed as an original. The emulsion surface of a contact photosensitive material (e) is brought into direct contact with the halftone original (d), and optically exposed.

After exposure, the contact photosensitive material is development-processed to produce white areas corresponding to line images inside the black halftone images.

A point of importance in the above-described method for forming white-on-black letter images is that the ideal of negative image/positive image conversion consists in accomplishing the conversion in accordance with individual dot areas of a halftone original and individual line widths of a line original, respectively. However, as is apparent from FIG. 1, the exposure for printing the line original (b) on the contact photosensitive material (e) is carried out with the sticking base (c) and the halftone original (d) sandwiched in between. This is in contrast to the exposure carried out for the halftone original (d) where the halftone original (d) is in direct contact with the emulsion surface of the contact photosensitive material.

Therefore, the optimum exposure for faithful negative image/positive image conversion with respect to the halftone original results in an out of focus line original because the sticking base (c) and the halftone image (d) are interposed as a spacer. As the result, narrowing of the line width of white-printed image corresponding to the line original is caused. This is responsible for deterioration in quality of the white-on-black letter image.

With the intention of resolving this problem, systems using a hydrazine compound are disclosed in JP-A-62-80640 (The term "JP-A" as used herein means an "unexamined published Japanese patent application"), JP-A-62-235938, JP-A-62-235909, JP-A-63-104046, JP-A-63-103235, JP-A-63-296031, JP-A-63-314541, and JP-A-64-13545. However these systems are not satisfactory, so it is desired that further improvements be introduced that overcome the above described problems.

As an attempt for improving image quality, there has also been known a method of releasing a development inhibitor from a redox compound containing a carbonyl group, in a distribution that corresponds to the silver image. This is disclosed, e.g., in JP-A-61-213847. However, this method has defects. Since the extension of screen range is insufficient and the range of image-tone control is narrower than that in a lithographic development system, notwithstanding the use of the redox compound, the method cannot function as a contrast development system for photographing a halftone image. Further, as the nucleation activity fluctuates from too high to too low depending on fluctuation in the developer composition (e.g., pH, concentration of sodium sulfite, etc.), the images obtained lack uniformity in quality and their value as commodities is impaired.

Therefore, photosensitive materials which enable the formation of high contrast halftone images using a stable developer and having controlled image tone over a wide range are desired.

SUMMARY OF THE INVENTION

A first object of this invention is to provide a photographic light sensitive material which has wide exposure latitude when photographing line originals, very high contrast (in particular a gamma value of 10 or more), and high resolution.

A second object of this invention is to provide a very high contrast photographic light-sensitive material which gives excellent reproduction of line originals that have a high background density (Dmax).

A third object of this invention is to provide a very high contrast photographic light sensitive material which has a wide exposure latitude when photographing line originals, and excellent halftone qualities including high density, clear-cut outline of dots, and uniformity in dot shape.

A fourth object of this invention is to provide a very high contrast photographic light-sensitive material which will consistantly yield excellent reproductions of an image with only slight variations in quality due to the fluctuation in composition of the developer used.

The above-described objects are attained by using a method for forming images comprising the steps of imagewise exposing silver halide photographic materials; and subjecting these imagewise exposed silver halide photographic materials to a development-processing, where these photographic materials contain a compound represented by the following general formula (I) and a redox compound, that can release a development inhibitor when oxidized, in said photographic material; and a bath used in the development processing contains a nucleation-development accelerator in said development-processing:

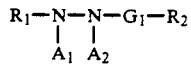

(I)

wherein $R_1$ represents an aliphatic group or an aromatic group; $R_2$ represents a hydrogen atom, an alkyl group, an aryl group, an alkoxy group, an aryloxy group, an amino group, a carbamoyl group, or an oxycarbonyl group; $G_1$ represents a carbonyl group, a sulfonyl group, a sulfoxy group,

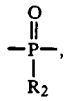

or an iminomethylene group; and $A_1$ and $A_2$ each represents a hydrogen atom, or one of $A_1$ or $A_2$ represents a hydrogen atom and the other represents a substituted or unsubstituted alkylsulfonyl group, a substituted or unsubstituted arylsulfonyl group, or a substituted or unsubstituted acyl group.

BRIEF DESCRIPTION OF THE DRAWINGS

FIG. 1(*a*) a transparent or translucent sticking base,

FIG. 1(*b*) a line original (the black part of which represents a line image),

FIG. 1(*c*) a transparent or translucent sticking base,

FIG. 1(*d*) a halftone original (the black part of which represents the presence of dots), and FIG. 1(*e*) a photosensitive material for contact work (the shaded part of which represents a photosensitive layer).

DETAILED DESCRIPTION OF THE INVENTION

Figures 1A, 1B, 1C, 1D, 1E:
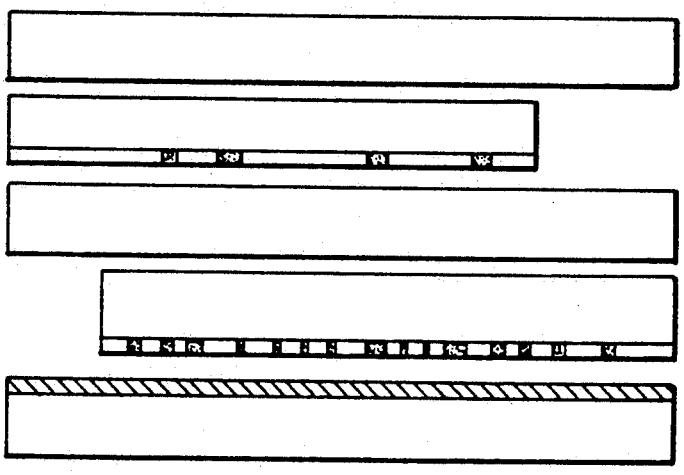
FIG. 1 shows a structure taken upon exposure for forming white-on-black letter images in accordance with the superimposition contact work, and the marks affixed thereto refer to the following constituent materials, respectively.

In formula (I), preferred aliphatic groups represented by $R_1$ include those containing 1 to 30 carbon atoms, especially straight-chain, branched and cyclic alkyl groups containing 1 to 20 carbon atoms. The branched alkyl groups may be cyclized so as to form a saturated hetero ring containing one or more hetero atoms. Further, these alkyl groups may be substituted by an aryl group, an alkoxy group, a sulfoxy group, a sulfonamido group, a carbonamido group.

The aromatic group represented by $R_1$ includes mono- and bicyclic aryl groups, and unsaturated heterocyclyl groups. The unsaturated heterocyclyl groups may include heteroaryl groups formed by condensation with a mono- or bicyclic aryl group. Specific examples of such aromatic groups include a phenyl group, a naphthyl group, a pyridyl group, a pyrimidyl group, an imidazolyl group, an pyrazolyl group, a quinolyl group, an isoquinolyl group, a benzimidazolyl group, a thiazolyl group, and a benzothiazolyl group. Among them, those containing a benzene ring are preferred over others. Groups particularly preferred as $R_1$ are aryl groups.

An aryl group and an unsaturated heterocyclyl group represented by $R_1$ may have a substituent group. Typical examples of such a substituent group include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, halogen atoms, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, and a phosphoric acid amido group. Particularly preferred substituents are a straight-chain, branched, or cyclic alkyl group (especially those containing 1 to 20 carbon atoms); an aralkyl group (especially mono- or bicyclic one which have an alkyl moiety containing 1 to 3 carbon atoms); an alkoxy groups (especially those containing 1 to 20 carbon atoms); a substituted amino group (especially those substituted by an alkyl group containing 1 to 20 carbon atoms); an acylamino group (especially those containing 2 to 30 carbon atoms); a sulfonamido group (especially those containing 1 to 30 carbon atoms); a ureido group (especially those containing 1 to 30 carbon atoms); and a phosphoric acid amido group (especially those containing 1 to 30 carbon atoms).

As for the alkyl group represented by $R_2$ in formula (I), those containing 1 to 4 carbon atoms are preferred, and these may be substituted by a halogen atom, a cyano group, a carboxyl group, a sulfo group, an alkoxy group, a phenyl group, or a sulfonyl group.

As for the aryl group, mono- and bicyclic aryl groups, e.g., those containing a benzene ring, are preferred. Such groups may be substituted by a halogen atom, an alkyl group, a cyano group, a carboxyl group, a sulfo group, a sulfonyl group.

As for the alkoxy group, those containing 1 to 8 carbon atoms are preferred, which may be substituted by a halogen atom or an aryl group.

As for the aryloxy group, monocyclic ones are preferred, and they may be substituted by a halogen atom.

As for the amino group, unsubstituted ones and those substituted by a 1 to 10 carbon alkyl group or an aryl group are preferred. The substituted ones may further be substituted by an alkyl group, a halogen atom, a cyano group, a nitro group, or a carboxyl group.

As for the carbamoyl group, unsubstituted ones and those substituted with a 1 to 10 carbon alkyl group or an aryl group are preferred. The substituted ones may further be substituted by an alkyl group, a halogen atom, a cyano group, or a carboxyl group.

As for the oxycarbonyl group, 2 to 10 carbon alkoxycarbonyl groups and aryloxycarbonyl groups are preferred. These may be further substituted by an alkyl group, a halogen atom, a cyano group, or a nitro group.

When $G_1$ represents a carbonyl group, those preferred as $R_2$ among the above described groups include a hydrogen atom; an alkyl group (e.g., methyl, trifluoromethyl, 3-hydroxypropyl, 3-methanesulfonamidopropyl, phenylsulfonylmethyl); an aralkyl group (e.g., o-hydroxybenzyl); or an aryl group (e.g., phenyl, 3,5-dichlorophenyl, o-methanesulfonamidophenyl, 4-methane sulfonylphenyl). In particular, a hydrogen atom is favored over the others.

When $G_1$ represents a sulfonyl group, those preferred as $R_2$ include an alkyl group (e.g., methyl); an aralkyl group (e.g., o-hydroxyphenylmethyl); an aryl group (e.g., phenyl); or a substituted amino group (e.g., dimethylamino).

When $G_1$ represents a sulfoxy group, those preferred as $R_2$ include a cyanobenzyl group or a methylthiobenzyl group.

When $G_1$ represents

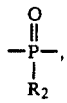

those preferred as $R_2$ include a methoxy group, an ethoxy group, a butoxy group, a phenoxy group, and a phenyl group. In particular, a phenoxy group is favored over the others.

When $G_1$ represents an N-substituted or unsubstituted iminomethylene group, those preferred as $R_2$ include a methyl group, an ethyl group, a substituted phenyl group, or an unsubstituted phenyl group.

Substituent groups with which the groups represented by $R_2$ may be substituted include those set forth with reference to $R_1$.

As for the group $G_1$ in formula (I), a carbonyl group is most favored.

In addition, $R_2$ may be a group that will split off the moiety $—G_1—R_2$ from the residual molecule and undergo a cyclization reaction that results in the formation of a cyclic structure containing atoms in the moiety $—G_1—_2$. In such a case, $R_2$ is represented by formula (a):

$$—R_3—Z_1 \qquad \text{(a)}$$

wherein $Z_1$ is a group capable of a nucleophilic attack against the group $G_1$ to split off the moiety, $G_1$—$R_3$—$Z_1$, from the residual molecule: and $R_3$ is the remainder of $R_2$ left after eliminating $Z_1$ from $R_2$, which forms a cyclic structure using $G_1$, $R_3$ and $Z_1$.

More specifically, $Z_1$ is a group capable of easily undergoing a nucleophilic reaction with the group $G_1$ when the hydrazine compound of formula (I) produces the reaction intermediate, $R_1$—N=N—$G_1$—$R_3$—$Z_1$. This nucleophilic reaction is an oxidation or the like, that splits off the group $R_1$N=N— form the group $G_1$. Examples of $Z_1$ include functional groups capable of reacting directly with the group $G_1$, such as —OH, —SH, —$NHR_4$ (wherein $R_4$ represents a hydrogen atom, an alkyl group, an aryl group, —$COR_5$ or —$SO_2R_5$, and $R_5$ represents a hydrogen atom, an alkyl group, an aryl group, or a heterocyclyl group); —COOH, (wherein OH, SH, $NHR_4$ and COOH may be temporarily protected so these groups are each produced by hydrolysis using an alkali or the like); and functional groups capable of reacting with the group $G_1$ through reaction with a nucleophilic reagent (e.g., hydroxide ion, sulfite ion), such as

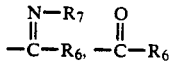

(wherein $R_6$ and $R_7$ are each a hydrogen atom, an alkyl group, an alkenyl group, an aryl group, or a heterocyclyl).

A ring formed by the group $G_1$, $R_3$ and $Z_1$ is preferably a 5- or 6-membered one.

Among the moieties represented by formula (a), those represented by formula (b) and those represented by formula (c) are favored over others.

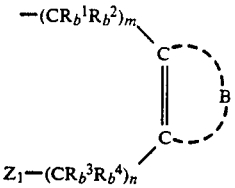

(b)

In the foregoing formula, substituents from $R_b^1$ to $R_b^4$ may be the same or different, each being a hydrogen atom, an alkyl group (preferably containing 1 to 12 carbon atoms), an alkenyl group (preferably containing 2 to 12 carbon atoms), or an aryl group (preferably containing 6 to 12 carbon atoms). B represents atoms necessary to complete an optionally substituted 5 or 6-membered ring. m and n each represent 0 or 1, provided that n+m is 1 or 2.

Specific examples of a 5- or 6-membered ring completed by B include a cyclohexene ring, a cycloheptene ring, a benzene ring, a naphthalene ring, a pyridine ring, a quinoline ring, and so on.

$Z_1$ has the same meaning as in formula (a).

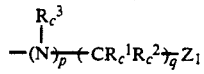

(c)

In the above formula, $R_c^1$ and $R_c^2$ may be the same or different, each being a hydrogen atom, an alkyl group, an alkenyl group, an aryl group, a halogen atom, or the like.

$R_c^3$ represents a hydrogen atom, an alkyl group, an alkenyl group, or an aryl group. p represents 0, 1 or 2, and q represents an integer from 1 to 4.

$R_c^1$, $R_c^2$ and $R_c^3$ may form a ring by combining with one another so far as they can retain such a structure to enable the intramolecular nucleophilic attack of $Z_1$ upon the group $G_1$.

$R_c^1$ and $R_c^2$ each is preferably a hydrogen atom, a halogen atom or an alkyl group, and $R_c^3$ is preferably an alkyl group or an aryl group. q is preferably an integer from 1 to 3. When q is 1, p represents 1 or 2, when q is 2, p represents 0 or 1, and when q is 3, p represents 0 or 1. When q is 2 or 3, $(CR_c^1R_c^2)$'s may be the same or different. $Z_1$ has the same meaning as in formula (a).

In formula (I), $A_1$ and $A_2$ can represent a hydrogen atom; an alkylsulfonyl group containing up to 20 carbon atoms; an arylsulfonyl group (preferably a phenylsulfonyl group, or phenylsulfonyl groups substituted so that the sum of Hammett's sigma values is at least −0.5); or an acyl group containing preferably up to 20 carbon atoms (preferably a benzoyl group, benzoyl groups substituted so that the sum of Hammett's sigma values is at least −0.5, or straight-chain, branched or cyclic, unsubstituted or substituted aliphatic acyl groups (wherein specific examples of such substituent groups include a halogen atom, an ether group, a sulfonamido group, a carbonamido group, a hydroxyl group, a carboxyl group, and a sulfonic acid group)).

A substituent group which is most favored as $A_1$ and $A_2$ is a hydrogen atom.

$R_1$ or $R_2$ in formula (I) may also be a group into which a ballast group to be used in a nondiffusible photographic additive like a coupler is introduced. The ballast group is a group containing at least 8 carbon atoms and comparatively inert in terms of photographic properties. It can be chosen from among alkyl groups, alkoxy groups, phenyl groups, alkylphenyl groups, phenoxy groups, alkylphenoxy groups.

Also, $R_1$ or $R_2$ in formula (I) may be a group into which a moiety capable of promoting the adsorption of a compound of the general formula (I) to surfaces of silver halide grains is introduced. Specific examples of such an adsorption group include thiourea groups, heterocyclic thioamido groups, mercaptoheterocyclyl groups, triazole groups and so on, disclosed in U.S. Pat. Nos. 4,385,108, and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-6-270744, JP-A-62-948, JP-A-63-234244, and JP-A-63-234246.

Specific examples of the compound represented by formula (I) are illustrated below. However, the invention should not be construed as being limited to these examples.

I-1)
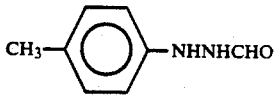
I-2)
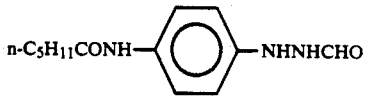
I-3)
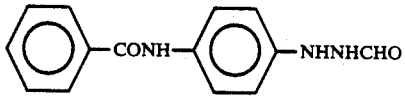
I-4)
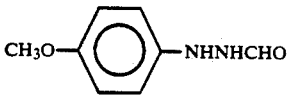
I-5)
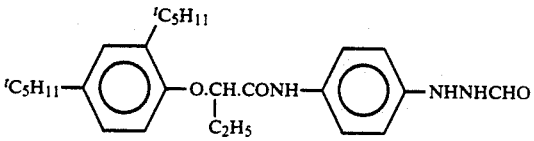
I-6)
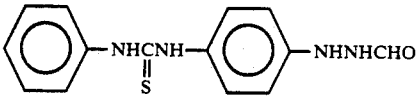
I-7)
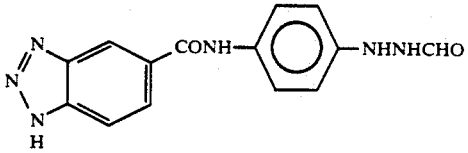
I-8)
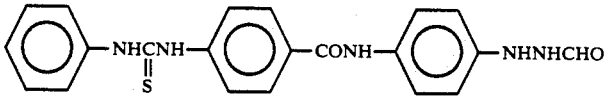
I-9)
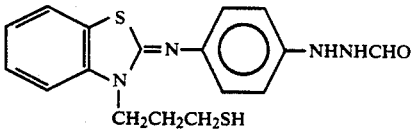
I-10)
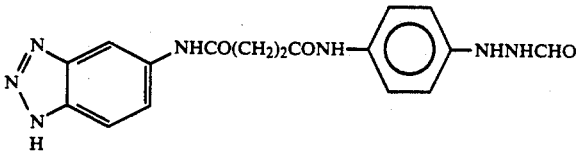
I-11)
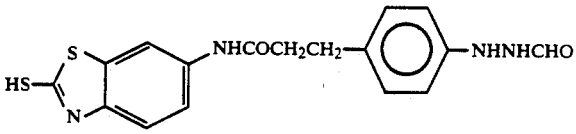

-continued
I-12)
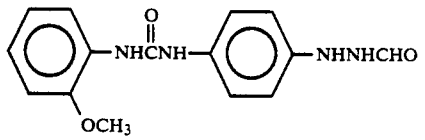
I-13)
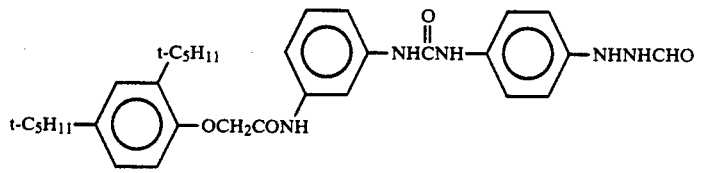
I-14)
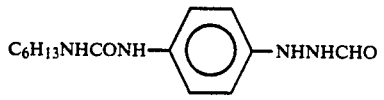
I-15)
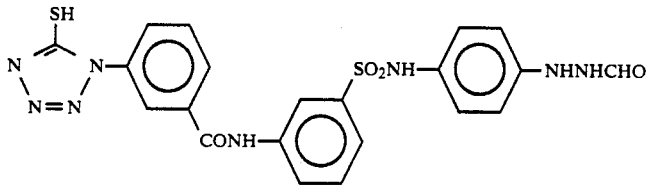
I-16)
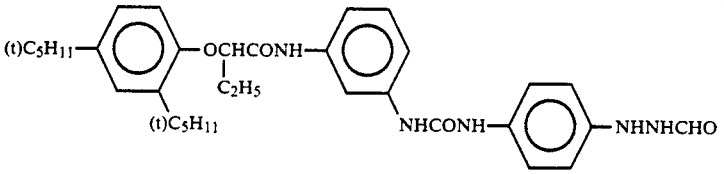
I-17)
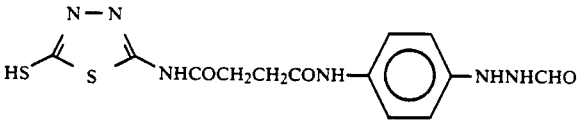
I-18)
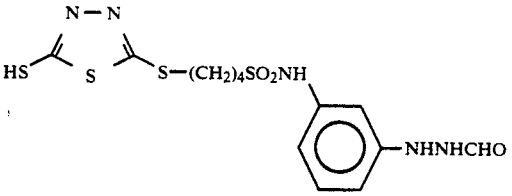
I-19)
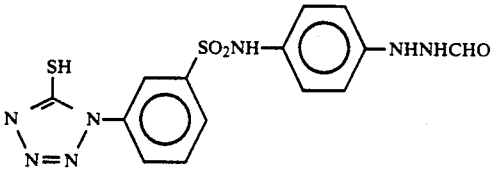
I-20)
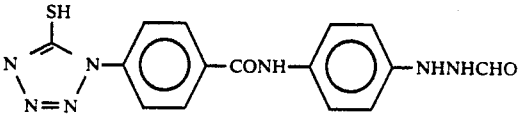

-continued
I-21)
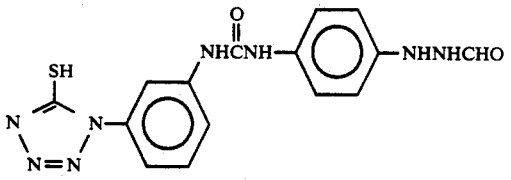
I-22)
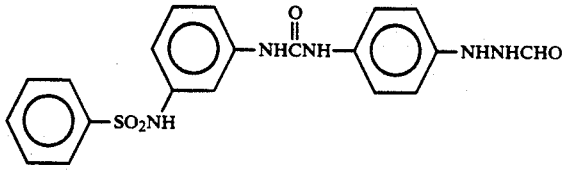
I-23)
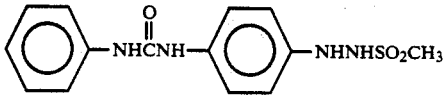
I-24)
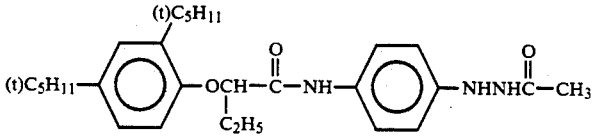
I-25)
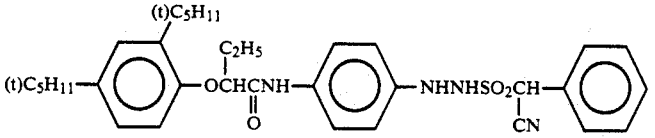
I-26)
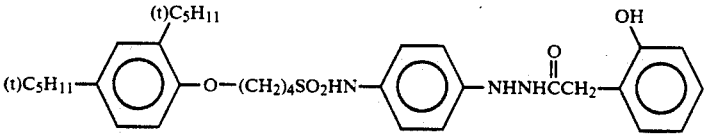
I-27)
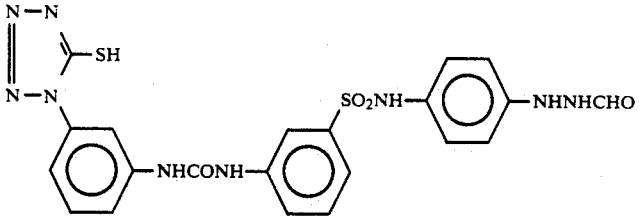
I-28)
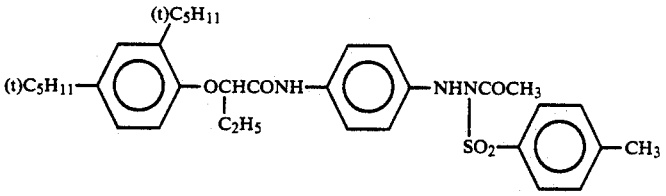
I-29)
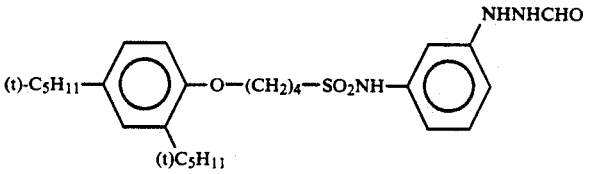

-continued
I-30)
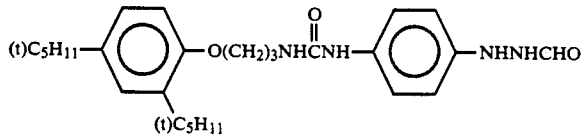
I-31)
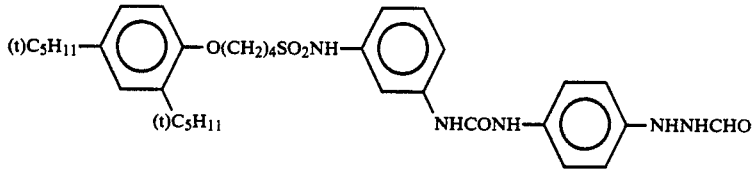
I-32)
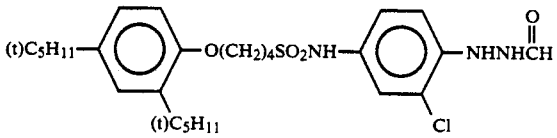
I-33)
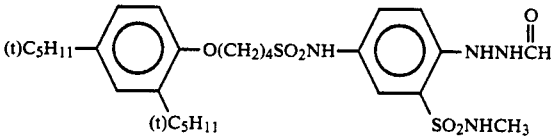
I-34)
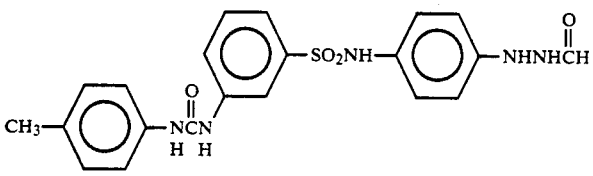
I-35)
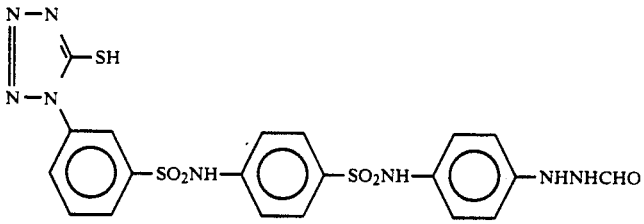
I-36)
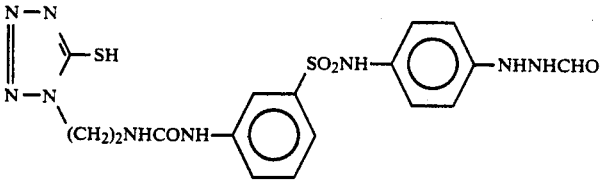
I-37)
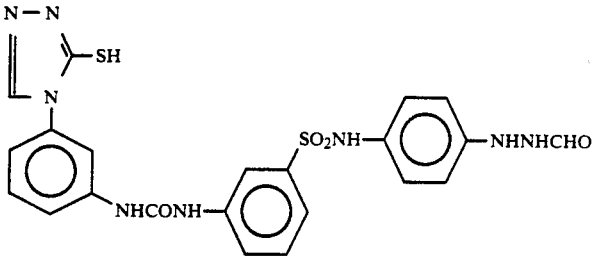

-continued
I-38)
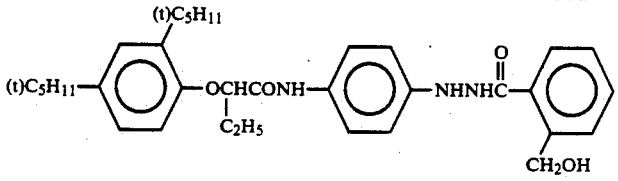
I-39)
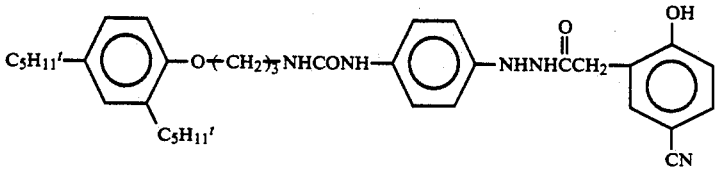
I-40)
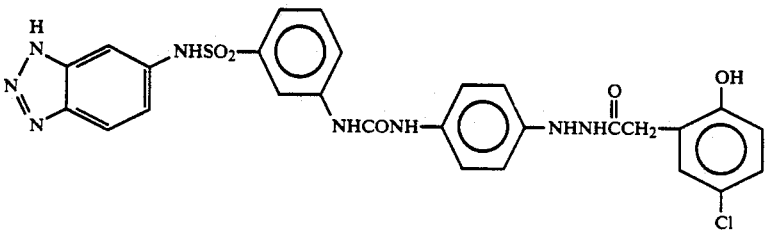
I-41)
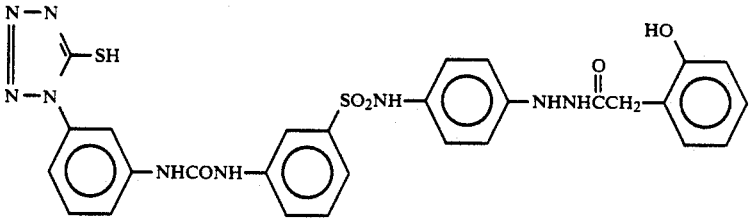
I-42)
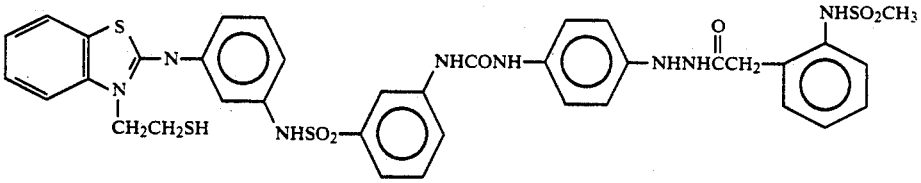
I-43)
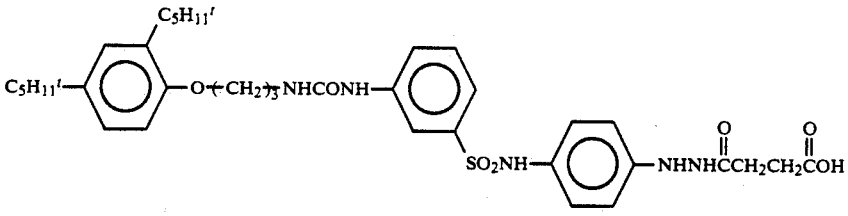
I-44)
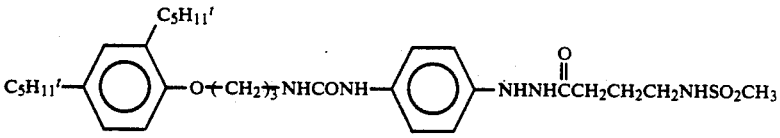
I-45)
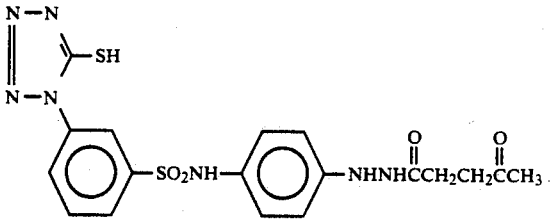

-continued
I-46)
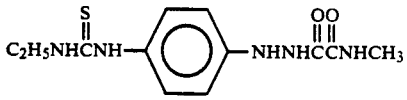
I-47)
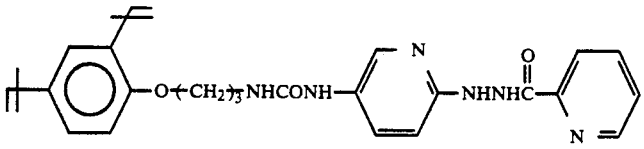
I-48)
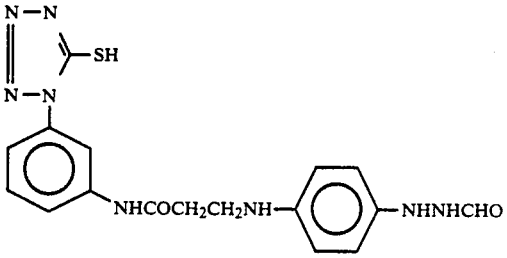
I-49)
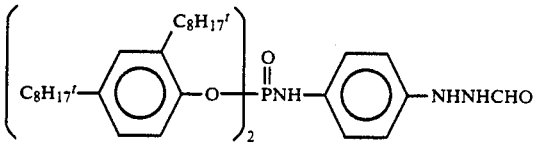
I-50)
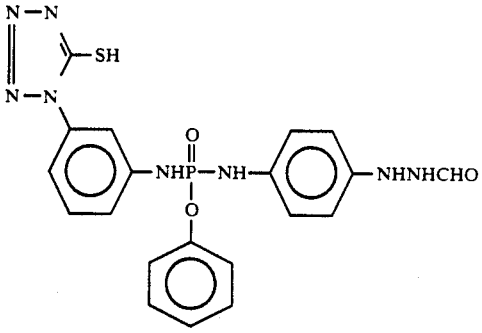
I-51)
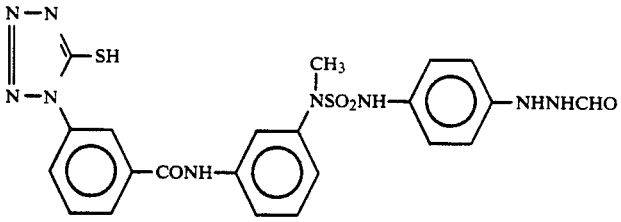
I-52)
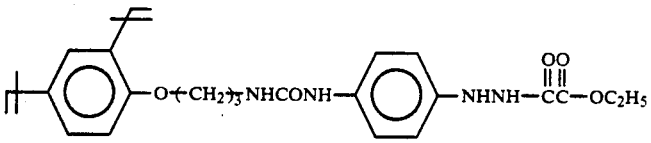
I-53)
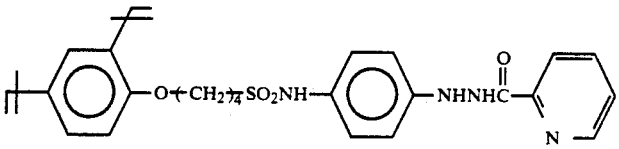

-continued

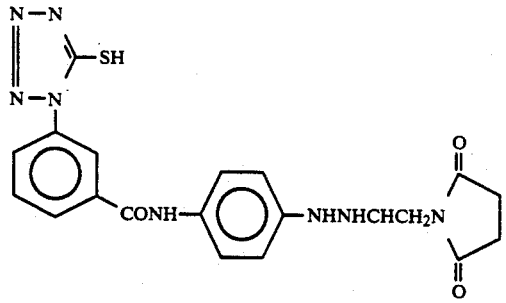

1-54)

In addition to the above-illustrated hydrazine derivatives, those disclosed in *Research Disclosure,* Item 23516, page 346 (Nov. 1983); those described in the reference quoted therein; and those disclosed in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, EP 217,310, JP A-63-32538, JP-A-63-104047, JP-A-63-121838, JP-A-63-129377, JP-A-63-223744, JP-A-63-294552, JP-A-63-306448 and JP-A-1-10233, U.S. Pat. No. 4,686,167, JP-A-62-178246, JP-A-63-234244, JP-A-63-234245, JP-A-63-234246, JP-A-63-294552, JP-A-63-306438, JP-A-1-90439, JP-A-1-269936, JP-A-1-283548, JP-A-1-280747, JP-A-1-283548, JP A-1-285940, and Japanese Patent Application Nos. 63-147339, 63-179760, 63-229163, 1-18377, 1-18378, 1-18379, 1-15755, 1-16814, 1-40792, 1 42615 and 1-42616 are hydrazine derivatives that can be used in this invention.

Incorporation of a hydrazine derivative of formula (I) into a photographic emulsion layer or a hydrophilic colloid layer can be effected by first dissolving it in water or a water-miscible organic solvent (if necessary, in the form of a salt formed by addition of the hydroxide of an alkali or a triacidic amine); and then adding the resulting solution to a hydrophilic colloid solution (e.g., a silver halide emulsion or an aqueous solution of gelatin). (The pH of the solution may be controlled by the addition of an acid or an alkali, if desired).

The compounds represented by formula (I) of this invention may be used alone or as a mixture of two or more. These compounds are added in an amount ranging preferably from $1\times10^{-6}$ mole to $5\times10^{-2}$ mole, and more preferably from $1\times10^{-5}$ mole to $1\times10^{-2}$ mole, per mole of silver halide, depending on the properties of a silver halide emulsion to be used in combination.

Examples of a useful nucleation-development accelerator to be contained in the development-processing bath of this invention include amine compounds disclosed in JP-A-56-106244, JP-A-61-267759, JP-A-61-30145, JP-A-62-211647, and JP-A-63-50247; and benzyl alcohol derivatives disclosed in JP-A-60-200250.

Compounds preferred as the nucleation-development accelerator are those represented by formula (II):

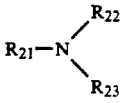

(II)

wherein $R_{21}$, $R_{22}$ and $R_{23}$ each represent a substituted or unsubstituted alkyl group selected so as to satisfy the requirement that the sum of the logarithmic values (log P) of the n-octanol/water partition coefficients of H—$R_{21}$, H—$R_{22}$ and H—$R_{23}$ ranges from 2.6 to less than 10.0.

In particular, compounds having the sum of the log P values in the range of from 3.0 to less than 8.0 are preferred and those having the sum of the log P values in the range of from 3.0 to 5.0 are more preferred.

The compounds represented by formula (II) are illustrated below in more detail.

Specific examples of substituent groups contained in substituted alkyl groups represented by $R_{21}$ to $R_{23}$ include a hydroxyl group, an alkoxy group, a carboxyl group, a sulfo group, an aryloxy group, and an amino group.

As for the logarithmic value of the foregoing n-octanol/water partition coefficient (log P), a calculation method therefor is described in *Substituent Constants for Correlation Analysis in Chemistry and Biology,* and *Handbook of Chemical Property Estimation Methods.* The log P values defined in this invention are determined in accordance with the above-cited method.

Now, log P values of typical compounds represented by H—$R_{21}$, H—$R_{22}$ and H—$R_{23}$ are set forth below. Logarithmic values of n-octanol/water partition coefficients log p) of H—$R_{21}$, H—$R_{22}$ and H—$R_{23}$ :

| H—$R_{21}$, H—$R_{22}$ and H—$R_{23}$ | log P value |
|---|---|
| H—$CH_2CH_2CH_3$ | 2.32 |
| H—$CH_2CH_2CH_2CH_3$ | 2.86 |
| 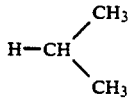 | 2.32 |
| 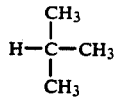 | 2.73 |
| H—$(CH_2)_4CH_3$ | 3.40 |
| H—$(CH_2)_5CH_3$ | 3.94 |
| H—$(CH_2)_6CH_3$ | 4.48 |
| H—$CH_2CH_2O$— | 2.61 |
| H—$CH_2CH_2OC_4H_9$(n) | 2.00 |
| H—$C_2H_5$ | 1.78 |
| H—$CH_2CH_2OH$ | −0.21 |
| H—$CH_2CH_2CH_2OH$ | 0.33 |
| H—$CH_2CH_2OCH_2CH_2OH$ | −0.17 |
| H—$CH_2CHCH_2OH$ (OH) | −1.03 |
| H—$CH_2CH_2CH_2CH_2OH$ | 0.870 |

-continued

| H—$R_{21}$, H—$R_{22}$ and H—$R_{23}$ | log P value |
|---|---|
| $H-CH_2\underset{\underset{OH}{\vert}}{C}HCH_2CH_2CH_2COO^{\ominus}$ | −4.35 |
| $H(CH_2)_6OH$ | 1.950 |
| $H(CH_2)_8OH$ | 3.030 |
| $H-CH_2CH_2OCH_2CH_2OCH_2CH_2OH$ | −0.431 |
| $H-CH_2\underset{\underset{OH}{\vert}}{C}HCH_2SO_3^{\ominus}$ | −4.16 |
| $H-CH_2CH_2OCH_3$ | 0.66 |

Specific examples of the amino compounds represented by formula (II) are illustrated below. However, the invention should not be construed as being limited to these examples.

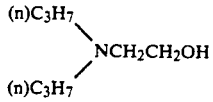
II-1)

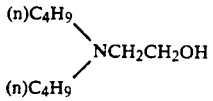
II-2)

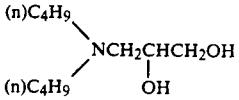
II-3)

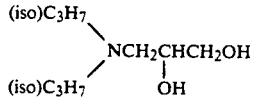
II-4)

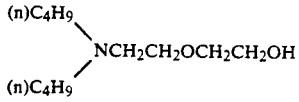
II-5)

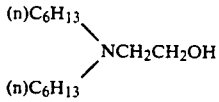
II-6)

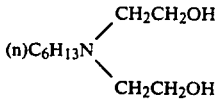
II-7)

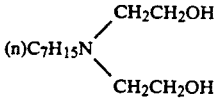
II-8)

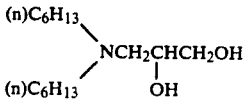
II-9)

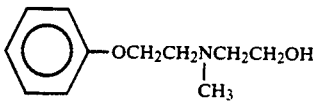
II-10)

-continued

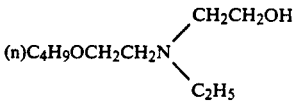
II-11)

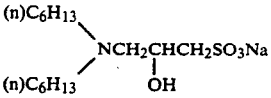
II-12)

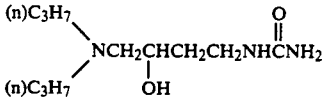
II-13)

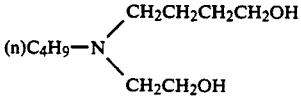
II-14)

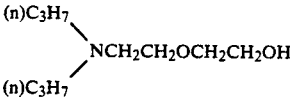
II-15)

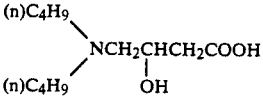
II-16)

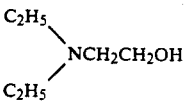
II-17)

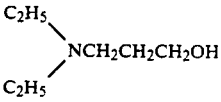
II-18)

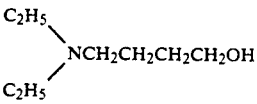
II-19)

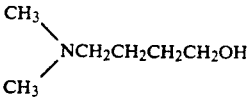
II-20)

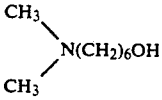
II-21)

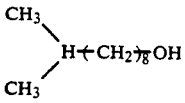
II-22)

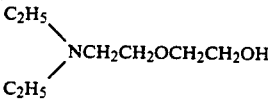
II-23)

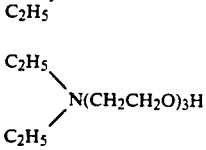
II-24)

-continued

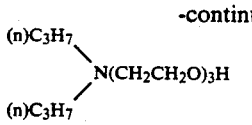
II-25)

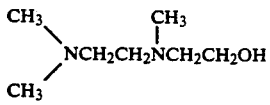
II-26)

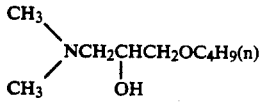
II-27)

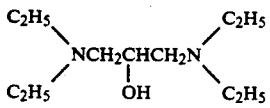
II-28)

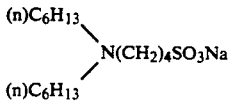
II-29)

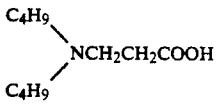
II-30)

The amino compounds represented by formula (II) markedly facilitate an increase in contrast even when added in a small amount. This is in contrast to other amino compounds. In addition, they do not cause silver stain because of their weak action as a silver halide solvent.

The amino compounds represented by the general formula (II) are preferably used in an amount of from 0.01 to 0.30 mole, most preferably from 0.01 to 0.20 mole, per liter of a developer.

Since the amino compounds represented by formula (II) have comparatively low solubilities in an aqueous developer there sometimes occurs a deposition or precipitation of these amino compounds if for convenience or preservation the concentration per unit volume of the developer is increased. The combined use with a compound represented by the following formulae (IV) or (V), however, makes it possible to prevent the above-described deposition or precipitation from occurring when the developer is concentrated.

$$R_{24}—SO_3M \quad (IV)$$

$$R_{25}—COOM \quad (V)$$

In the above formulae, M represents a hydrogen atom, Na, K or $NH_4$; and $R_{24}$ and $R_{25}$ each represent an alkyl group containing at least 3 carbon atoms, an alkylphenyl group, or phenyl group.

Specific examples of the compound represented by formula (IV) include sodium p-toluenesulfonate, sodium benzenesulfonate, and sodium 1-hexanesulfonate. Specific examples of the compound represented by formula (V) include sodium benzoate, sodium p-toluylate, potassium isobutyrate, sodium n-caproate, sodium n-caprylate, sodium caprate, and so on.

A proper concentration of the compound represented by formulae (IV) or (V) in a developer depends on the concentration of the amino compound of the foregoing formula (II), and is generally 0.005 mol/l or higher, preferably from 0.03 to 0.1 mol/l. An appropriate ratio of the compound of formulae (IV) or (V) to the amino compound of formula (II) is from ½ to 20/1 by mole.

A redox compound which can release a development inhibitor when oxidized is illustrated below.

Suitable examples of the redox moiety such a redox compound include residues of hydroquinones, catechols, naphthohydroquinones, aminophenols, pyrazolidones, hydrazines, hydroxylamines, and reductones. Among these, residues of hydrazines are more preferred than others.

Compounds particularly preferred as the redox compound of this invention are those represented by formula (III):

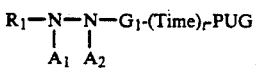
(III)

wherein $R_1$, $A_1$, $A_2$ and $G_1$ have the same meanings as in formula (I), respectively; Time represents a divalent linkage group; t represents 0 or 1; and PUG represents a development inhibitor.

The compounds of formula (III) are described in more detail, below. The substituent groups $R_1$, $A_1$, $A_2$ and $G_1$, have the same specific descriptions as discussed above in formula (I).

Examples of a divalent linkage group represented by Time are those releasing a photographically useful group (PUG) through an intramolecular ring-closure reaction of a p-nitrophenoxy derivative, disclosed in U.S. Pat. No. 4,248,962 (corresponding to JP-A-54-145135); those releasing PUG through an intramolecular ring-closure reaction succeeding a ring cleavage, as disclosed in U.S. Pat. No. 4,310,612 (corresponding to JP-A-55-53330), and U.S. Pat. No. 4,358,252; those releasing PUG with the production of an acid anhydride by an intramolecular ring-closure reaction of a succinic acid monoester or the carboxyl group of an analog thereof, as disclosed in U.S. Pat. Nos. 4,330,617, 4,446,216 and 4,483,919, and JP-A-59-121328; those releasing PUG by the production of a quinomonomethane or an analog thereof from an aryloxy or heterocyclyloxy group through the electron transfer via conjugated double bonds, as disclosed in U.S. Pat. Nos. 4,409,323 and 4,421,845, *Research Disclosure*, No. 21228 (Dec. 1981), U.S. Pat. No. 4,416,977 (corresponding to JP-A-57-135944), JP-A-58-209,736, and JP-A 58-209738; those releasing PUG from the gamma position of an enamine through electron transfer in the enamine form-having moiety of a nitrogen-containing hetero ring, as disclosed in U.S. Pat. No. 4,420,554 (corresponding to JP-A-57-136640), JP-A-57-135945, JP-A-57 188035, JP-A-58-98728, and JP A-58-209737; those releasing PUG through an intramolecular ring-closure reaction of the oxy group produced by electron transfer to the carbonyl group having a conjugate relation with the nitrogen atom of a nitrogen-containing hetero ring, as disclosed in JP-A-57-56837; those releasing PUG with the production of aldehydes, as disclosed in U.S. Pat. No. 4,146,396 (corresponding to JP-A-52-90932), JP-A-59-93442, and JP-A-59-75475; those releasing PUG with the decarbonation of a carboxy group, as disclosed in JP-A-51-146828, JP-A-57-179842 and JP-A-59-104641; those having a formula of —O—COO-$CR_aR_b$—PUG and releasing PUG with the decarboxylation and the aldehyde production subsequent thereto; those releasing PUG with the production of an isocyanate, as disclosed in JP-A-60-7429; and those releasing PUG through a coupling reaction with the oxidation product of a color developer, as disclosed in U.S. Pat. No. 4,438,193.

Specific examples of these divalent linkage groups represented by Time are also described in detail in JP-A-61-236549, and JP-A-1-269936. Among them, those preferred over others are illustrated below. Herein, the mark (*) indicates the site at which —(Time)$_r$—PUG combines with G, and the mark (*)(*) indicates the site at which Time combines with PUG in formula (III).

T-(1)

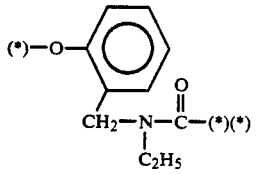

T-(2)

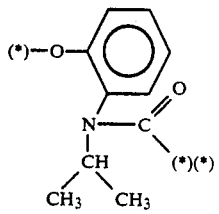

T-(3)

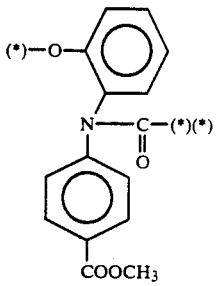

T-(4)

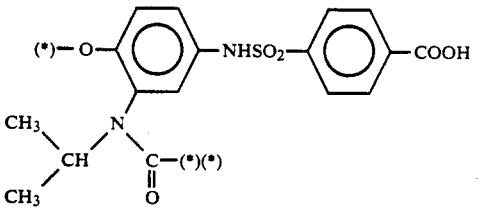

T-(5)

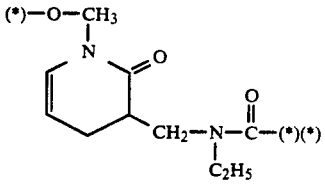

T-(6)

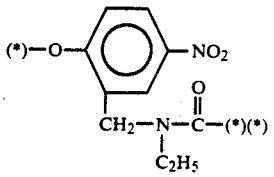

-continued

T-(7)

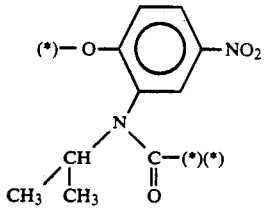

T-(8)

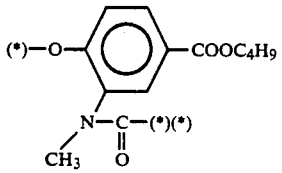

T-(9)

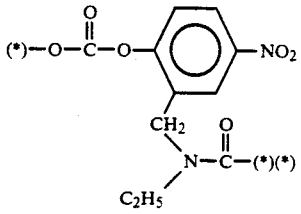

T-(10)

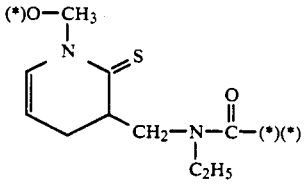

T-(11)

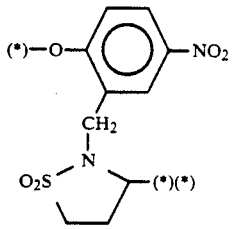

T-(12)

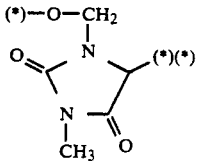

T-(13)

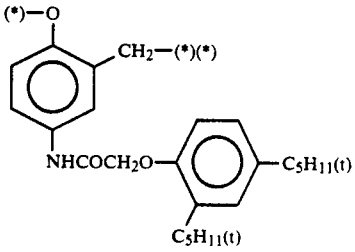

-continued
T-(14)
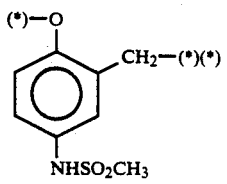
T-(15)
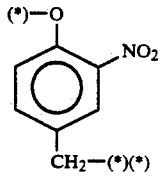
T-(16)
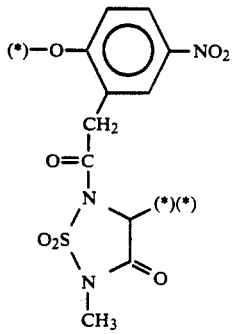
T-(17)
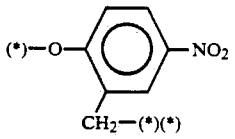
T-(18)
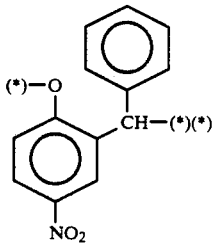
T-(19)
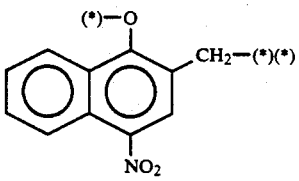
T-(20)
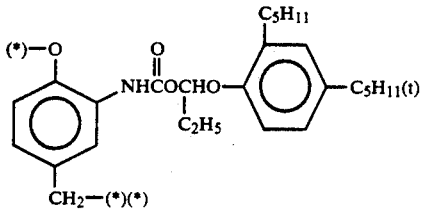
-continued
T-(21)
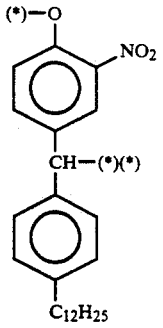
T-(22)
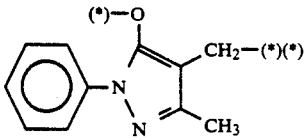
T-(23)
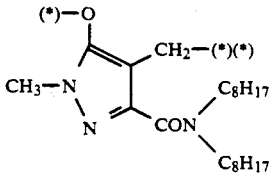
T-(24)
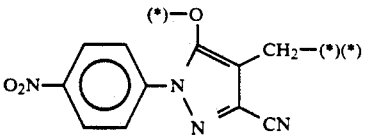
T-(25)
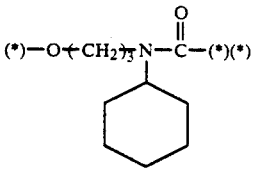
T-(26)
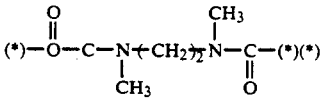
T-(27)
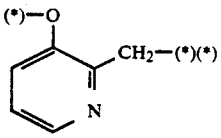
T-(28)
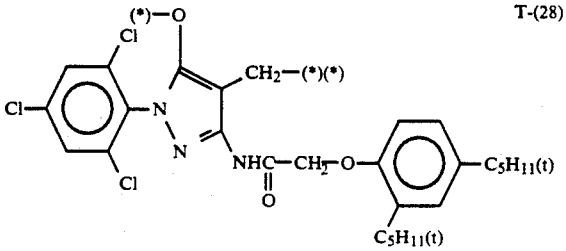

-continued

T-(29)

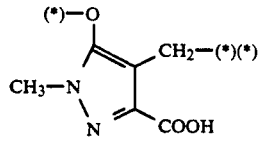

T-(30)

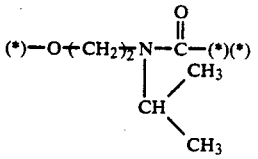

T-(31)

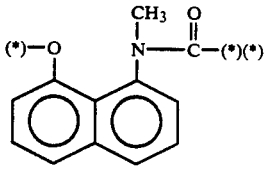

T-(32)

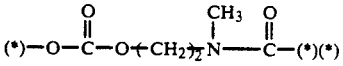

T-(33)

T-(34)

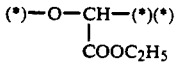

T-(35)

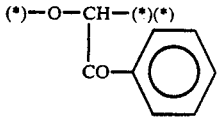

T-(36)

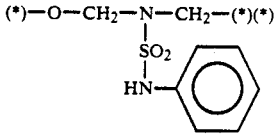

T-(37)

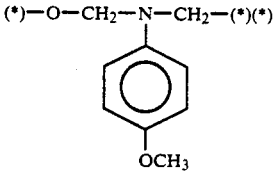

T-(38)

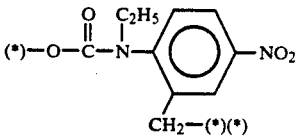

T-(39)

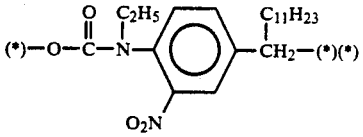

T-(40)

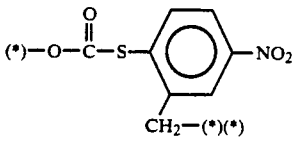

-continued

T-(41)

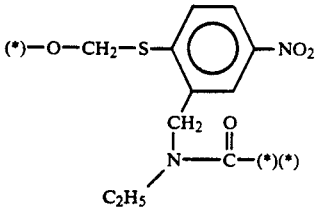

T-(42)

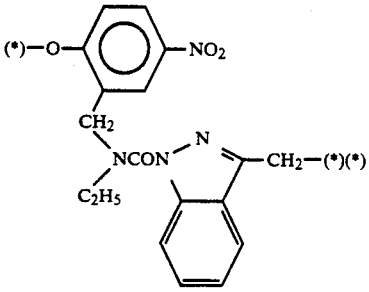

PUG represents a group having a development inhibiting effect in the form of (Time)—PUG or PUG.

A development inhibitor represented by (Time)—PUG or PUG contains a hetero atom, via which it is bound to the other moiety of the foregoing redox compound, and includes known ones as described, e.g., in C. E. K. Mees and T. H. James, *The Theory of Photographic Processes,* Third Edition, pages.344-346, Macmillan (1966). More specific examples are mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, and mercaptoaryls.

The development inhibitor represented by PUG may have a substituent group. Examples of such a substituent group include the following, which may further be substituted: an alkyl group, an aralkyl group, an alkenyl group, an alkynyl group, an alkoxy group, an aryl group, a substituted amino group, an acylamino group, a sulfonylamino group, a ureido group, an urethane group, an aryloxy group, a sulfamoyl group, a carbamoyl group, an alkylthio group, an arylthio group, a sulfonyl group, a sulfinyl group, a hydroxyl group, a halogen atom, a nitro group, a cyano group, a sulfo group an alkyloxycarbonyl group, an aryloxycarbonyl group, an acyl group, an alkoxycarbonyl group, an acyloxy group, a carbonamido group, a sulfonamido group, a carboxyl group, a sulfoxy group, a phosphono group, a phosphinico group, a phosphoric acid amido group.

Among these substituents, a nitro group, a sulfo group, a carboxyl group, a sulfamoyl group, a phosphono group, a phosphinico group and a sulfonamido group are favored over others.

Main development inhibitors are described below.

A. Mercaptotetrazole Derivatives (1) 1 Phenyl 5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole (7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4 Methoxyphenyl)-5-mercaptotetrazole
(12) 1-(2-Methoxyphenyl) 5-mercaptotetrazole
(13) 1-(4-(2-Hydroxyethoxy)-phenyl)-5-mercaptotetrazole
(14) 1-(2,4-Dichlorophenyl)-5-mercaptotetrazole
(15) 1-(4-Dimethylaminophenyl)-5 mercaptotetrazole
(16) 1-(4-Nitrophenyl)-5-mercaptotetrazole
(17) 1,4-Bis(5-mercapto-1-tetrazolyl)benzene
(18) 1-(Alpha-naphthyl) 5-mercaptotetrazole
(19) 1-(4-Sulfophenyl)-5-mercaptotetrazole
(20) 1-(3-Sulfophenyl)-5-mercaptotetrazole
(21) 1-(Beta-naphthyl)-5-mercaptotetrazole
(22) 1-Methyl-5 mercaptotetrazole
(23) 1-Ethyl-5-mercaptotetrazole
(24) 1-Propyl-5-mercaptotetrazole
(25) 1-Octyl-5-mercaptotetrazole
(26) 1 -Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl) 5-mercaptotetrazole
(31) 1-(2-aminoethyl)-5-mercaptotetrazole hydrochloride
(32) 1-(2-Diethylaminoethyl)-5-mercaptotetrazole
(33) 2-(5-Mercapto-1-tetrazolyl)ethyltrimethylammonium chloride
(34) 1-(3-Phenoxycarbonylphenyl)-5-mercaptotetrazole
(35) 1-(3-maleinimidophenyl)-5-mercaptotetrazole B. Mercaptotriazole Derivatives (1) 4-Phenyl-3-mercaptotriazole
(2) 4-Phenyl 5 methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl) 3-mercaptotriazole
(7) 4-Alpha-naphthyl)-3-mercaptotriazole
(8) 4-(4-Sulfophenyl)-3-mercaptotriazole
(9) 4-(3-Nitrophenyl)-3-mercaptotriazole C. Mercaptoimidazole Derivatives (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole D. MercaptopVrimidine Derivatives (1) Thiouracil
(2) Methylthiouracil
(3) Ethylthiouracil
(4) Propylthiouracil
(5) Nonylthiouracil
(6) Aminothiouracil
(7) Hydroxythiouracil E. Mercaptobenzimidazole Derivatives (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy 2-mercaptobenzimidazole
(7) 2-Mercaptonaphthimidazole
(8) 2-Mercapto-5-sulfobenzimidazole
(9) 1-(2 Hydroxyethyl)-2-mercaptobenzimidazole
(10) 5-Capronamido-2-mercaptobenzimidazole
(11) 5-(2-Ethylhexanoylamino)-2-mercaptobenzimidazole F. Mercaptothiadiazole Derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio-2-mercapto 1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole G. Mercaptobenzothiazole Derivatives (1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole H. Mercaptobenzoxazole Derivatives (1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole I. Benzotriazole Derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chloro benzotriazole
(10) 4,5,6-Trichlorobenzotriazole
(11) 5-Carboxybenzotriazole
(12) Sodium salt of 5-sulfobenzotriazole
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole J. Benzimidazole Derivatives (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole K. Indazole Derivatives (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole (8) 3-Chloro-5-nitroindazole
(9) 3-Carboxy-5-nitroindazole L. Tetrazole Derivatives (1) 5-(4-Nitrophenyl)tetrazole
(2) 5-Phenyltetrazole
(3) 5-(3-carboxyphenyl-tetrazole M. Tetraazaindene Derivatives (1) 4-Hydroxy-6-methyl-5-nitro-1,3,3a,7-tetraazaindene
(2) 4-Mercapto-6-methyl-5-nitro-1,3,3a,7-tetraazaindene N. Mercaptoaryl Derivatives (1) 4-Nitrothiophenol
(2) Thiphenol
(3) 2-Carboxythiophenol $R_1$ or —(Time)$_r$—PUG in formula (III) may include a ballast group as usually employed in immobile photographic additives, including couplers, or a group capable of promoting the adsorption of a compound of formula (III) to silver halide grains.

"Ballast group" refers to an organic group that furnishes high enough molecular weight to make it impossible for a compound represented by formula (III) to diffuse in a substantial sense into different layers or processing solutions. A ballast group is composed of one or more of the following: an alkyl group, an aryl group, a heterocyclyl group, an ether group, a thioether group, an amide group, an ureido group, an urethane group, and a sulfonamide group. Preferred ballast groups include those containing a substituted benzene ring, especially those containing a benzene ring substituted by a branched alkyl group or groups.

Specific examples of groups capable of promoting the adsorption to silver halide grains include cyclic thioamido groups, such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, 1,3-imidazoline-2-thione and the like; chain thioamido groups; aliphatic mercapto groups; aromatic mercapto groups; heterocyclic mercapto groups (which bear a tautomer relationship to cyclic thioamido groups when they contain a nitrogen atom in the neighborhood of the carbon atom to which an —SH group is bound, with specific examples including the same groups as those cited above); groups containing disulfide linkage residues of 5- or 6-membered nitrogen-containing hetero rings that are composed of nitrogen, oxygen, sulfur and carbon atoms, such as benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene; and heterocyclic quaternary salts such as benzimidazolium.

Each of these groups may also contain a substituent group. Examples of such a substituent group are the same as those given as examples of substituent groups for $R_1$.

Specific examples of the compound of formula (III) to be used in this invention are illustrated below. However, the invention should not be construed as being limited by these examples.

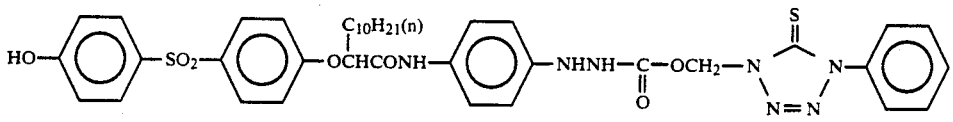

III-1)

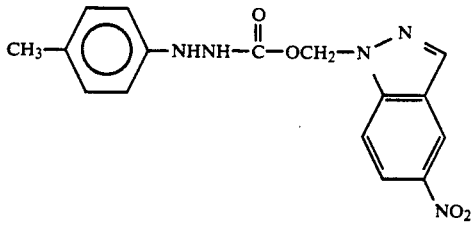

III-2)

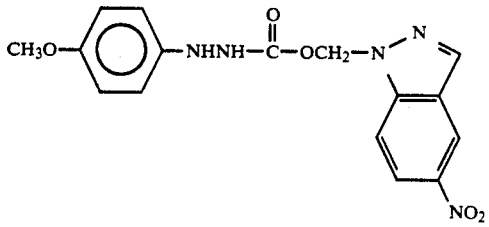

III-3)

-continued
III-4)
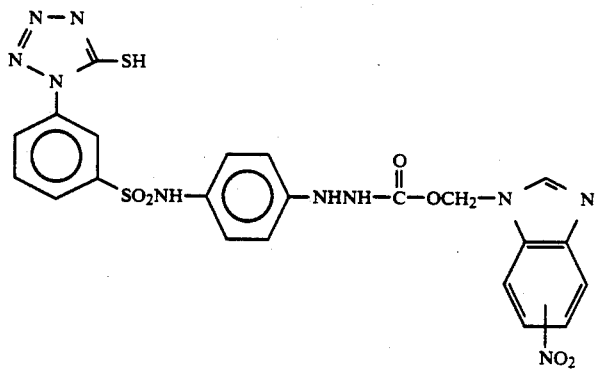
III-5)
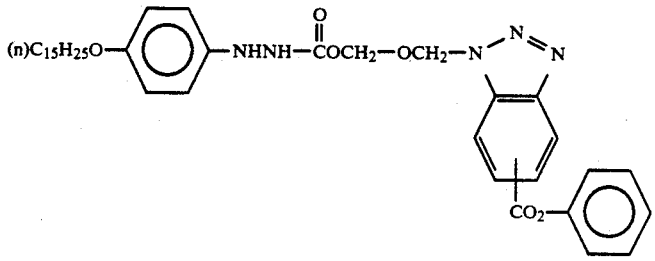
III-6)
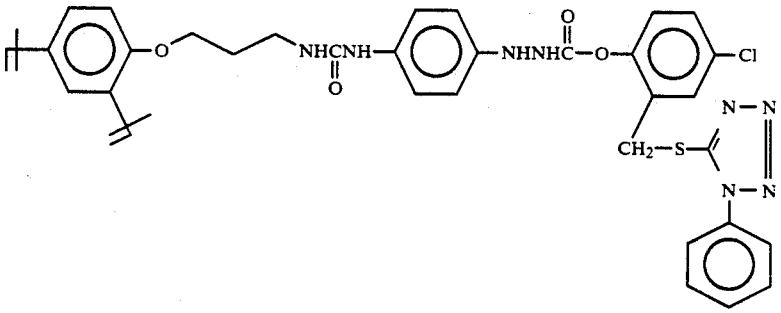
III-7)
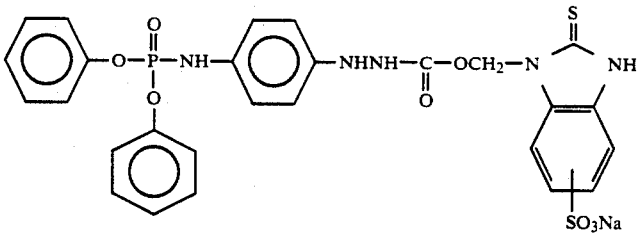
III-8)
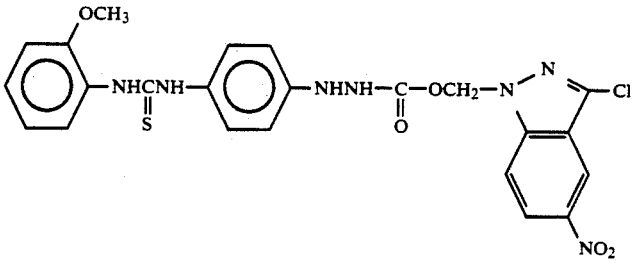
III-9)
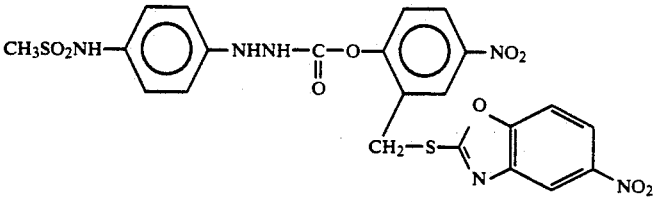

-continued
III-10)
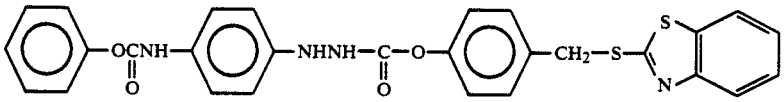
III-11)
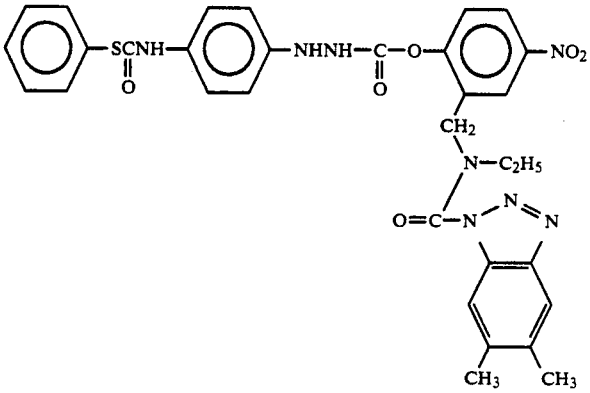
III-12)
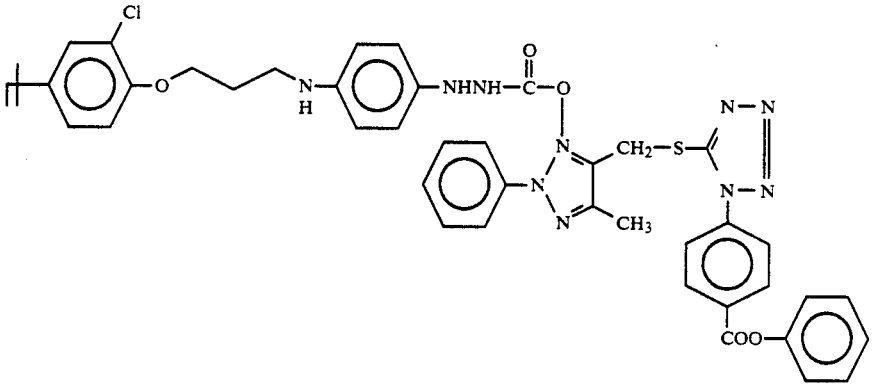
III-13)
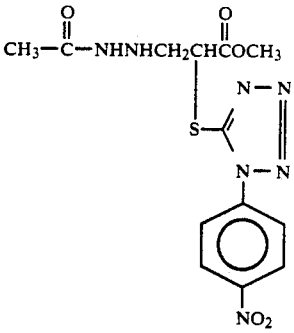
III-14)
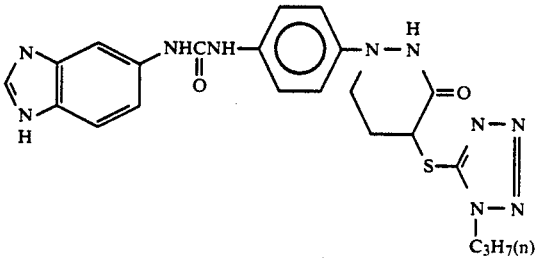

-continued
III-15)
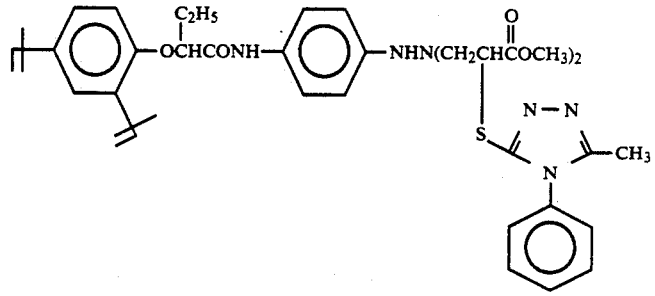
III-16)
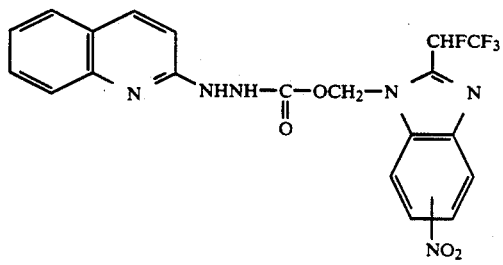
III-17)
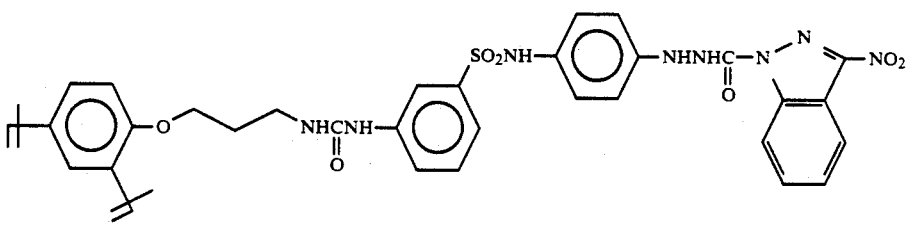
III-18)
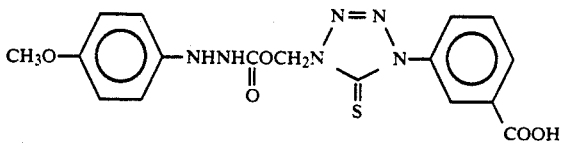
III-19)
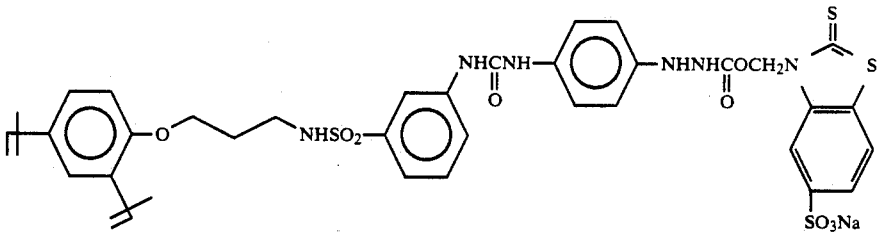
III-20)
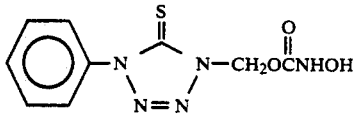
III-21)
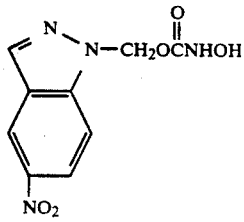

-continued
III-22)
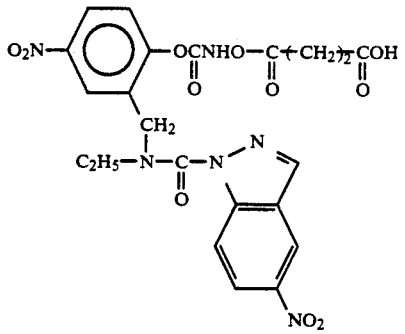
III-23)
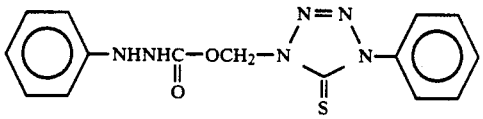
III-24)
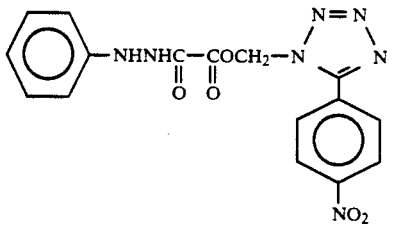
III-25)
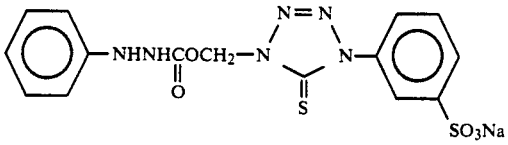
III-26)
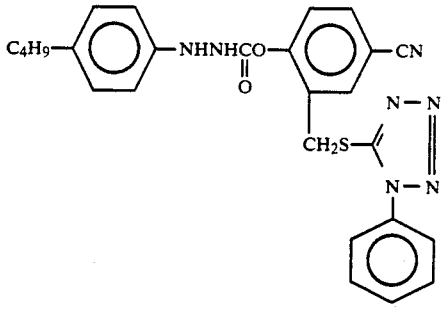
III-27)
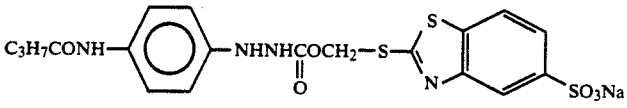
III-28)
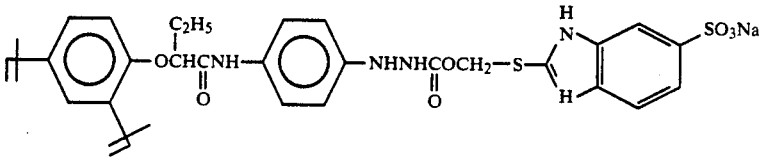

-continued
III-29)
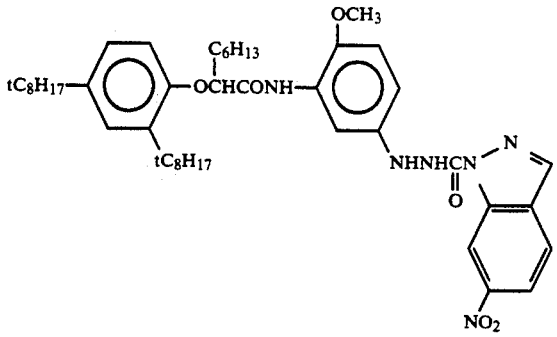
III-30)
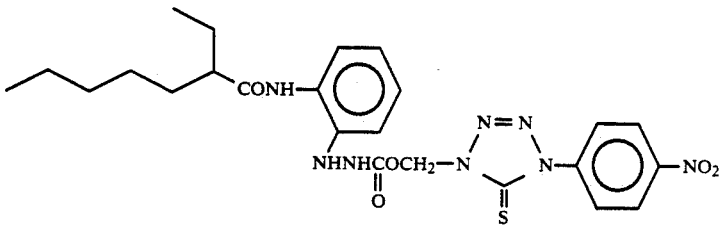
III-31)
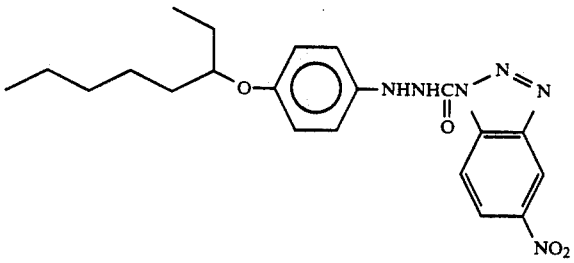
III-32)
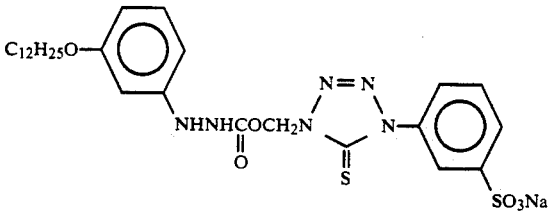
III-33)
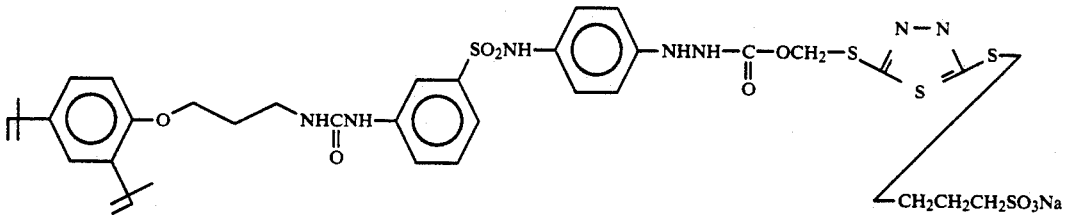
III-34)
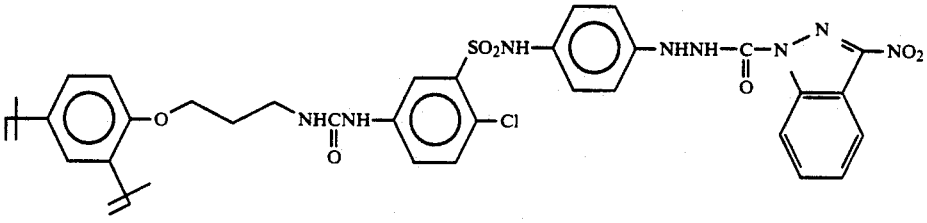

-continued
III-35)
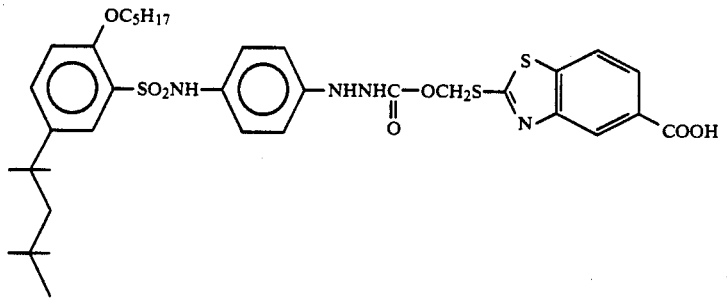
III-36)
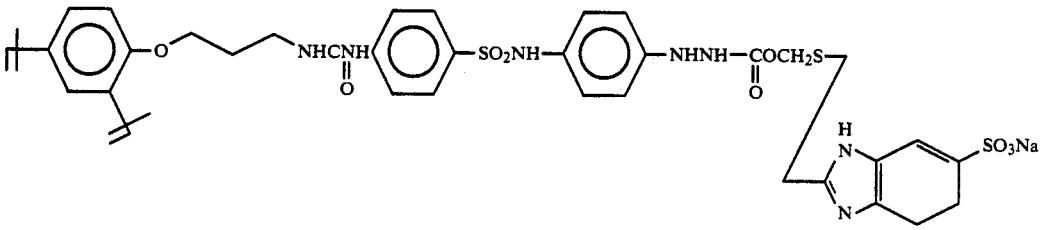
III-37)
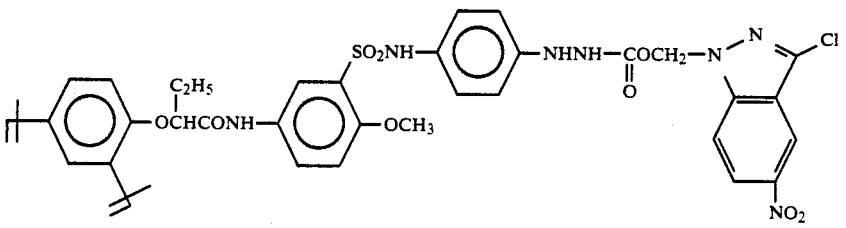
III-38)
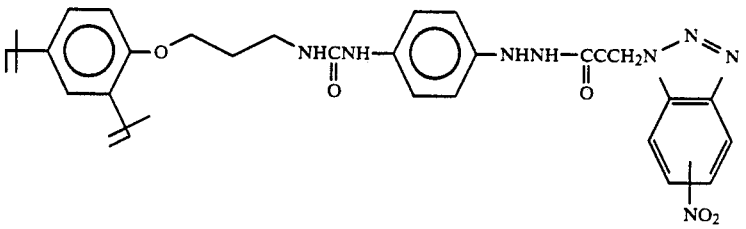
III-39)
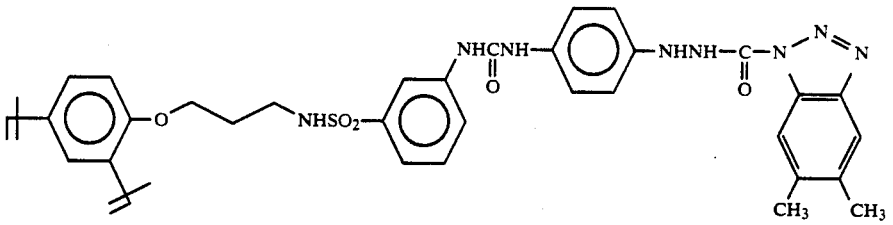
III-40)
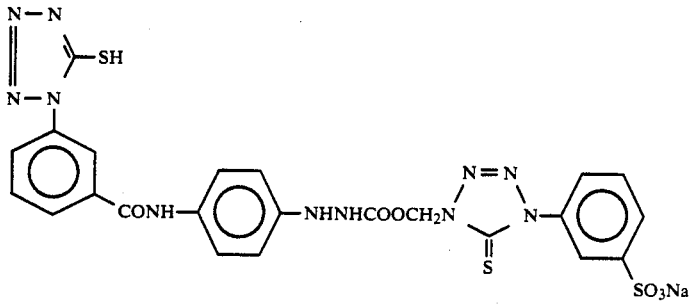

-continued
III-41)
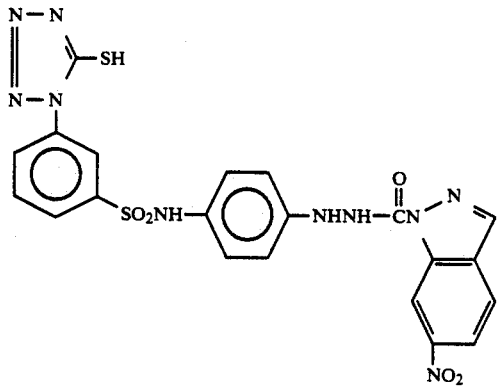
III-42)
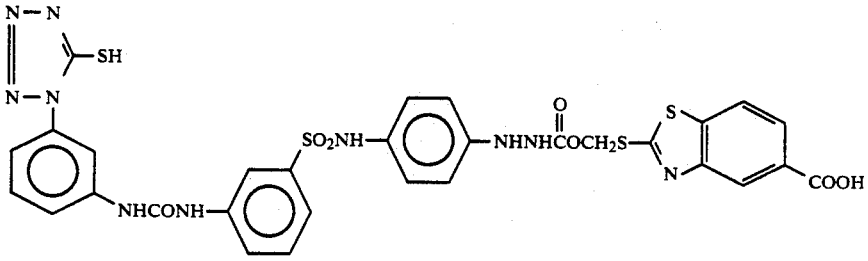
III-43)
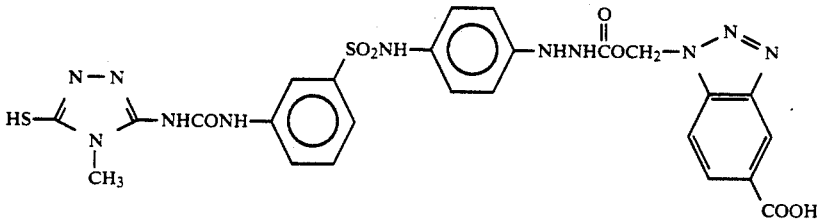
III-44)
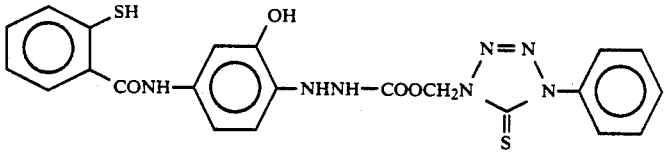
III-45)
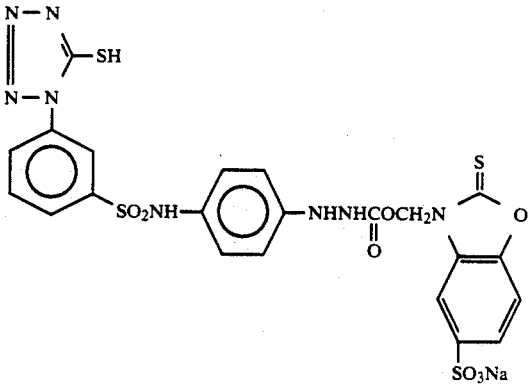

-continued

III-46)

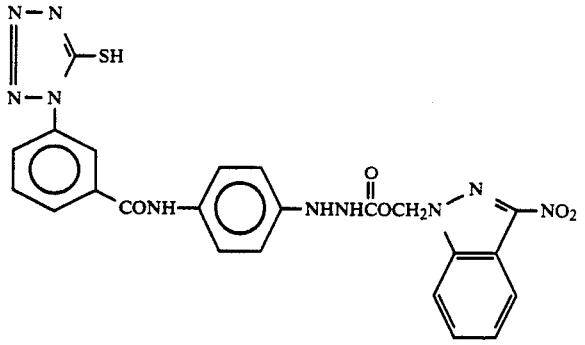

III-47)

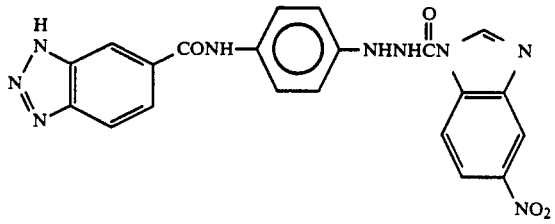

III-48)

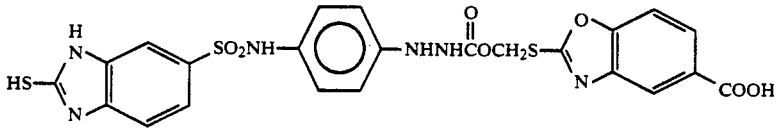

III-49)

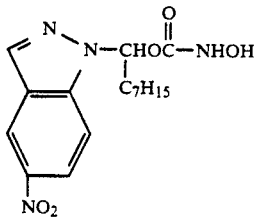

III-50)

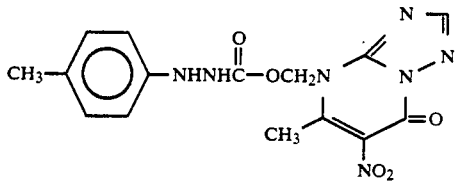

Methods for synthesizing redox compounds which can be employed in this invention are described in JP-A-61-213847, JP-A 62-260153, U.S. Pat. No. 4,684,604, JP-A-1-269936, U.S. Pat. Nos. 3,379,529, 3,620,746, 4,377,634 and 4,332,878, JP-A-49-129536, JP-A-56-153336, and JP-A-56-153342.

The redox compounds to be used in this invention are used in an amount ranging from $1\times10^{-5}$ to $5\times10^{-2}$ mole, preferably from $2\times10^{-5}$ to $1\times10^{-2}$ mole, per mole of silver halide.

In using these compounds, they can be dissolved in a proper water-miscible organic solvent, such as alcohols (e.g., methanol, ethanol, propanol, fluorinated alcohols), ketones (e.g., acetone, methyl ethyl ketone), dimethylformamide, dimethyl sulfoxide, or methyl cellosolve.

On the other hand, they may be used in the form of an emulsified dispersion, which can be prepared using any well-known emulsifying dispersion method. One such method involves a compound dispersed in an oil, such as dibutyl phthalate, tricresyl phosphate, glyceryl triacetate, or diethyl phthalate with the aid of an auxiliary solvent, such as ethyl acetate or cyclohexanone, and emulsified mechanically. Another solid dispersion method involves a pulverized compound dispersed in water by means of a ball mill, a colloid mill, or ultrasonic waves.

The compounds of this invention, represented by formulae (I) and (III) respectively, can provide a negative image with high contrast when combined use in a negative emulsion. These compounds can also be used in combination with a silver halide emulsion having high internal sensitivity, but low surface sensitivity. However, it is preferred that the compounds represented by the general formula (I) and (III) be combined and used with a negative emulsion for the formation of a high contrast negative image.

When used to form a high contrast negative image, it is desirable that fine-grained silver halides (e.g., those having an average grain size of 0.7 micron or less), especially silver halides having an average grain size of 0.5 micron or less, should be employed. Such silver halides do not have any particular restriction with respect to the grain size distribution, but it is desired that the negative emulsions should be monodisperse. The terminology "monodisperse emulsion" as used herein refers to an emulsion in which at least 95% of the constituent grains have their individual sizes within the range of ±40% of the average grain size.

Silver halide grains may have any crystal form, including regular crystal forms, e.g., that of a cube, octahedron, rhombododecahedron or tetradecahedron, irregular crystal forms, e.g., that of a sphere, a tablet or so on, and composite forms of two or more of these crystal forms.

The silver halide grains may be uniform throughout, or the interior and the surface thereof may be different from each other.

In a process of producing silver halide emulsion grains to be used in this invention or allowing the produced silver halide emulsion grains to ripen physically, cadmium salts, zinc salts, lead salts, thallium salts, rhodium salts or complexes, iridium salts or complexes, may be present.

Silver halides which can be used in this invention are prepared in the presence of from $10^{-8}$ to $10^{-5}$ mol/mol Ag of an iridium salt or a complex salt thereof, and have an iodide content distribution such that the iodide content of the surface part of each grain is higher than the average iodide content of the whole grain. The use of an emulsion containing silver haloiodide of this kind yields a photographic material of still higher sensitivity and high gamma value.

The silver halide emulsions to be used in this invention may be chemically sensitized ones although this is not a necessity. Known methods for chemical sensitization of silver halide emulsions include sulfur sensitization, reduction sensitization, and noble metal sensitization methods. Chemical sensitization may be carried out using these methods independently or in combination.

An example of a noble metal sensitization method is the gold sensitization method, wherein a gold compound, mainly a gold complex salt, is used. Complex salts of noble metals other than gold, e.g., platinum, palladium, and rhodium, may be used together. Specific examples of noble metal sensitization are disclosed, e.g., in U.S. Pat. No. 2,448,060 and British Patent 618,016. Specific examples of sulfur sensitization are sulfur compounds contained in gelatin, and other sulfur compounds, such as sodium thiosulfate, thioureas, thiazoles, and rhodanines.

It is desired in the above-described situation that an iridium or rhodium salt be used before the conclusion of physical ripening, particularly at the time of grain formation, in the course of making the silver halide emulsion.

From the standpoint of the elevation in maximum density (Dmax), it is desirable in this invention that the silver halide emulsion layer contain two kinds of monodisperse emulsions differing in average grain size, as disclosed in JP-A-61-223734 and JP A 62-90646. Further, it is desired that the monodisperse grains smaller in average size should be chemically sensitized, especially by the use of a sulfur sensitization method. The monodisperse grains greater in average size may be chemically sensitized, or not. In general, the monodispers grains of greater size are not subjected to chemical sensitization because of their tendency to generate black spots. However, they may be chemically sensitized, if desired, as long as chemical sensitization is carried out to a slight extent to avoid the generation of black spots. The expression "carried out to a slight extent" means that the chemical sensitization is carried out for a reduced period of time, at a lowered temperature, and using reduced amounts of chemical sensitizers, compared with the chemical sensitization for the grains of smaller size.

This invention does not have any particular restriction with respect to the sensitivity difference between the monodisperse emulsion of greater size and that of smaller size. However, it is desirable that the sensitivity difference range from 0.1 to 1.0, preferably from 0.2 to 0.7, expressed in Δlog E, and the monodisperse emulsion of greater size have higher sensitivity.

The sensitivity as adopted herein is determined according to a process that comprises incorporating the hydrazine derivatives in each emulsion, coating them on a support, and developing the emulsion coat with a developer containing not less than 0.15 mol/l of sulfite ion and adjusted to pH 10.5 to 12.3. An average grain size of the monodisperse grains smaller in size is 90% or less, preferably 80% or less, of the average grain size of the monodisperse grains greater in size. An average grain size of the silver halide emulsion grains ranges preferably from 0.02 to 1.0 micron, and more preferably from 0.1 to 0.5 micron. Accordingly, it is desirable that both the average grain sizes should be within the above-described range.

When two or more kinds of emulsions different in grain size are used in this invention, a proportion of the monodisperse emulsion smaller in grain size to the whole emulsions is controlled to from 40 to 90 wt %, preferably from 50 to 80 wt %, of silver.

In applying monodisperse emulsions having a different grain size to this invention, they may be introduced into the same emulsion layer, or into separate emulsion layers, respectively. In the latter case, it is desirable that the emulsion having the grater grain size be introduced into an upper layer, while the emulsion having the smaller grain size be introduced into a lower layer.

In addition, a total silver coverage is preferably within the range of 1 to 8 g/m$^2$.

The photosensitive material to be used in this invention can contain sensitizing dyes as disclosed in JP-A-55-52050, pp. 45–53 (e.g., cyanine dyes or merocyanine dyes), to enhance the sensitivity. These sensitizing dyes may be employed individually or in combination. Combinations of sensitizing dyes are often employed for supersensitization. Substances which can exhibit a supersensitizing effect in combination with a certain sensitizing dye although they themselves do not spectrally sensitize silver halide emulsions or do not absorb light in the visible region may also be incorporated into the silver halide emulsions. Useful sensitizing dyes, supersensitizing combinations of dyes, and substances which can exhibit a supersensitizing effect are described in *Research Disclosure*, vol. 176, No. 17643, p. 23, Items IV-J (Dec. 1978).

The photosensitive material of this invention can contain a wide variety of compounds for preventing fogging and stabilizing photographic functions during the production, storage or photographic processing. More specifically, such compounds that can be added are azoles such as benzothiazolium salts, nitroindazoles, chlorobenzimidazoles, bromobenzimidazoles, mercaptothiazoles, mercaptobenzthiazoles, mercaptothiadiazoles, aminotriazoles, benzothiazoles, and nitrobenzotriazoles; mercaptopyrimidines; mercaptotriazines; thioketo compounds such as oxazolinethione; azaindenes, such as triazaindenes, tetraazaindenes (especially (1,3,3a,7) tetraazaindenes substituted with a hydroxy group at the 4-position), and pentaazaindenes; and many other compounds known as antifoggants or stabilizers, such as benzenethiosulfonic acid, benzenesulfinic acid, and benzenesulfonic acid amide. Of these compounds, preferred are benzotriazoles (e.g., 5-methyl-benzotriazole) and nitroindazoles (e.g., 5-nitroindazole). Also, these compounds may optionally be contained in a processing solution.

As development accelerators well-suited for use in this invention or as accelerators for nucleation infectious development, the compounds disclosed in JP-A-53-77616, JP-A-54-37732, JP-A-53-137133, JP-A-60-140340, JP-A-60-14959, and various kinds of compounds containing nitrogen or sulfur atom(s) are effective.

Such accelerators, though the respective optimal amounts depend on their properties, are added in an amount ranging from $1.0\times10^{-3}$ to 0.5 g per square meter, preferably from $5.0\times10^{-3}$ to 0.1 g per square meter.

Organic desensitizers that can be used in this invention are defined by their half-wave potentials in polarography, or their redox potentials as determined by polarography. Included are compounds whose respective sums of polarographic anode potential and cathode potential may be positive. Methods of determining the redox potential in polarography are described, e.g., in U.S. Pat. No. 3,501,307. Preferred organic desensitizers are those containing at least one water soluble group, e.g., a sulfonic acid group or a carboxyl group, which form a salt when combined with an organic base (e.g., ammonia, pyridine, triethylamine, piperidine, morpholine, or an alkali metal (e.g., sodium, potassium)).

More specifically, the compounds represented by formulae (III) to (V) disclosed in JP-A 63-133145, are preferably used as such organic desensitizers.

It is desirable in this invention that the organic desensitizers should be present in the silver halide emulsion layer in an amount of from $1.0\times10^{-8}$ to $1.0\times10^{-4}$ mole, preferably $1.0\times10^{-7}$ to $1.0\times10^{-5}$ mole, per square meter.

The emulsion layers of this invention and other hydrophilic colloid layers may contain water-soluble dyes for various purposes, e.g., as filter dyes and for prevention of irradiation. As filter dyes, ultraviolet absorbing agents having their respective spectral absorption maxima in the intrinsic sensitivity region of silver halides, and dyes which can substantially absorb light of from 380 nm to 600 nm in wavelength to heighten safety against the safe-light used in handling the photosensitive material of this invention are preferred.

These dyes may be added to emulsion layers, if desired. They are preferably added to the hydrophilic colloid layers located on the upside of silver halide emulsion layers, that is to say, to layers located farther from the support than the silver halide emulsion layers, and fixed to these layers with the aid of a mordant.

The amount of ultraviolet absorbing agent added, depends on the molar extinction coefficient thereof, and ranges generally from $10^{-2}$ to 1 g/m$^2$, and preferably from 50 to 500 mg/m$^2$.

The ultraviolet absorbing agent used can be dissolved in a proper solvent, such as water, alcohol (e.g., methanol, ethanol, or propanol), acetone, or methyl cellosolve, and added to a coating composition.

Ultraviolet absorbing agents which can be used include benzotriazole compounds substituted by an aryl group, 4-thiazolidone compounds, benzophenone compounds, cinnamate compounds, butadiene compounds, benzoxazole compounds, and ultraviolet absorbing polymers.

Specific examples of such ultraviolet absorbing agents are disclosed in U.S. Pat. Nos. 3,533,794, 3,314,794 and 3,352,681, JP-A-46-2784, U.S. Pat. Nos. 3,705,805, 3,707,375, 4,045,229, 3,700,455 and 3,499,762, and West German Patent Publication 1,547,863.

Filter dyes which can be used in this invention include oxonol dyes, hemioxonol dyes, styryl dyes, merocyanine dyes, cyanine dyes, and azo dyes. Dyes that are soluble in water or can be decolored with an alkali or sulfite ion are preferred from the standpoint of reduction in the color stain remaining after photographic processing.

More specifically, the following dyes can be used: pyrazolone oxonol dyes disclosed in U.S. Pat. No. 2,274,782; diarylazo dyes disclosed in U.S. Pat. No. 2,956,879; styryl dyes and butadienyl dyes disclosed in U.S. Pat. Nos. 3,423,207 and 3,384,487; merocyanine dyes disclosed in U.S. Pat. No. 2,527,583; merocyanine dyes and oxonol dyes disclosed in U.S. Pat. Nos. 3,486,897, 3,652,284 and 3,718,472; enaminohemioxonol dyes disclosed in U.S. Pat. No. 3,976,661; and dyes disclosed in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

These dyes are dissolved in a proper solvent (such as water, alcohol (e.g., methanol, ethanol, propanol), acetone, methyl cellosolve, a mixture of two or more of these), and added to a coating composition for the light-insensitive hydrophilic colloid layer of this invention.

A suitable amount of these dyes to be added is generally within the range of from $10^{-3}$ to 1 g/m$^2$, and particularly from $10^{-3}$ to 0.5 g/m$^2$.

The photographic light-sensitive material of this invention may contain an inorganic or organic hardener in photographic emulsion layers or other hydrophilic colloid layers. Specific examples of such hardeners include chromium salts, aldehydes (e.g., formaldehyde, glutaraldehyde), N-methylol compounds (e.g., dimethylolurea), active vinyl compounds (e.g., 1,3,5-triacryloyl-hexahydro s-triazine, 1,3-vinylsulfonyl 2-propanol), active halogen compounds (e.g., 2,4-dichloro-6-hydroxy-s-triazine), and mucohalogenic acids. These hardeners can be used alone, or as mixture of two or more.

The photographic emulsion layers and other hydrophilic colloid layers of the photographic material prepared in accordance with this invention may contain various kinds of surface active agents for a wide variety of purposes, for instance, as a coating aid, to prevent electrification, to improve slippability, as an emulsifying dispersion, to prevent adhesion, as improvements in photographic characteristics (e.g., acceleration of development, increase in contrast, or sensitization). Surface active agents preferred in this invention are polyalkyleneoxides having a molecular weight of 600 or more as disclosed in JP-B-58-9412. (The term "JP-B" as used herein means an "examined Japanese patent publication".) It the surface active agent is also to as an antistatic agent, fluorine-containing surface active agents are favored (for details refer to U.S. Pat. No. 4,201,586, JP-A-60-80849 and JP-A-59-74554).

The photographic light sensitive material of this invention can contain a matting agent, such as silica, magnesium oxide, or polymethylmethacrylate in a photographic emulsion layer o another hydrophilic colloid layer in order to prevent the material from causing adhesion troubles.

For the purpose of improvements in dimensional stability the photographic emulsions of this invention can contain a dispersion of a synthetic polymer that is insoluble or slightly soluble in water. Synthetic polymers which can be used for the above purpose include those containing a constitutional repeating unit, for example an alkyl(meth)acrylate, an alkoxyacryl(meth) acrylate, or glycidyl(meth)acrylate. Such polymers can be use alone or in a combination of two or more. In addition, the above-cited polymers may be combined with acrylic acid or methacrylic acid.

It is desired that the silver halide emulsion and other layers of the photographic light sensitive material of this invention contain a compound having an acid group. Examples of acid group-containing compounds are organic acids (such as salicylic acid, acetic acid, and ascorbic acid) and homo- and co-polymers having as a constitutional repeating unit an acid monomer (such as acrylic acid, maleic acid, and phthalic acid). For details of these compounds descriptions in JP A-61-223834, JP-A-61-228437, JP-A-62-25745 and JP A-62-55642 can be referred to. As for the low molecular weight compounds among these compounds, ascorbic acid is particularly preferred over others. As for the high molecular weight compounds, water-dispersible latexes of copolymers prepared from acid monomers (such as acrylic acid) and cross-linking monomers having two or more of unsaturated groups (such as divinylbenzene) produce a particularly desirable effect.

To attain high contrast and high sensitivity photographic characteristics using the silver halide light-sensitive material of this invention, it is not necessary to employ a conventional infectious developer or a high alkaline developer having a pH value near to 13 as described in U.S. Pat. No. 2,419,975. A stable developer can be employed.

More specifically, the silver halide light-sensitive material of this invention produces a sufficiently high contrast negative image using a developer which contains not less than 0.15 mol/l of sulfite ion as a preservative, and is adjusted to pH 10.5 to 12.3, particularly pH 11.0 to 12.0.

The developer used in this invention is not particularly restricted as to developing agent. However, it is desirable in order to attain the highest halftone quality on the developed images that the developing agent comprise dihydroxybenzenes. In some cases, combinations of dihydroxybenzenes and 1-phenyl-3-pyrazolidones, or combinations of dihydroxybenzenes and p-aminophenols are employed.

In general, the developing agent is preferably used in a concentration of 0.05 to 0.8 mol/l. When a combination of a dihydroxybenzene and a 1-phenyl-3-pyrazolidone, or a combination of a dihydroxybenzene and a p-aminophenol is employed as developing agent, a desirable result is achieved using 0.05 to 0.5 mol/l of dihydroxybenzene and 0.06 mol/l or less of the pyrazolidone or aminophenol.

Specific examples of sulfite type preservatives used in this invention include sodium sulfite, potassium sulfite, lithium sulfite, ammonium sulfite, sodium bisulfite, potassium metabisulfate, or formaldehyde/sodium bisulfite.. A preferred concentration of a sulfite is 0.4 mol/l or more, preferably 0.5 mol/l or more.

In the developer used with this invention, compounds disclosed in JP-A-56-24347 can be used as silver stain inhibitor. Further, compounds disclosed in JP-A-61-267759 can be used as a dissolving aid to be added to the developer. Furthermore, compounds disclosed in JP-A-60-93433 and JP-A 62-186259 can be used as pH buffers to be added to the developer.

Besides being used in combination with a negative emulsion for the purpose of producing a high contrast photographic material, as described above, the compounds represented by general formulae (I) and (III) can also be used in combination with a silver halide emulsion having high internal sensitivity, but low surface sensitivity. Embodiments of the latter use are described below. In this case, the compounds represented by formulae (I) and (III) are preferably incorporated in the silver halide emulsion layer having high internal sensitivity but low surface sensitivity, though they may be contained in a hydrophilic colloid layer adjacent to the emulsion layer of the above-described kind. Examples of such a hydrophilic emulsion layer include a color material layer, an interlayer, a filter layer, a protective layer, an antihalation layer and other layers having any function, provided that they do not disturb the diffusion of the nucleating agent in relation to the silver halide grains.

Contents of the compounds represented by formulae (I) and (III) in the foregoing layer can be varied over a wide range depending on the characteristics of the silver halide emulsions used, the chemical structure of the nucleating agent and the development condition. However, practically useful contents are within the range of about 0.005 to 500 mg, particularly about 0.01 to about 100 mg, per mole of silver in the emulsion layer having high internal sensitivity but low surface sensitivity. As for the content in the hydrophilic colloid layer adjacent to the emulsion layer, quantities equivalent to the above-described range determined on the basis of the silver contained in the same area of the hydrophilic colloid layer are sufficient. The definition of the silver halide emulsion having high internal sensitivity but low surface sensitivity is described, e.g., in JP A-61-170733 (the upper column on page 10), and British Patent 2,089,057 (pages 18–20).

Emulsions having high internal sensitivity but low surface sensitivity which are preferably used in this invention are described in JP-A-63 108336 (from 14th line on page 28 to 2nd line on page 31). Preferred silver halide grains for such emulsions are described in Supra (from 3rd line on page 31 to 11th line on page 32).

When an emulsion having high internal sensitivity but low surface sensitivity is used in the photographic material of this invention, it may be sensitized with sensitizing dyes so as to acquire high spectral sensitivity to blue light of relatively longer wavelengths, green light, red light or infrared light. For example, cyanine dyes, merocyanine dyes, complex cyanine dyes, complex merocyanine dyes, holopolar cyanine dyes, styryl dyes, hemicyanine dyes, oxonol dyes, and hemioxonol dyes can be used as sensitizing dyes. These sensitizing dyes include cyanine and merocyanine dyes disclosed, e.g., in JP-A-59-40638, JP-A-59-40636 and JP-A-59 38739.

The photographic material of this invention can contain color image-forming couplers as color materials, or they can be developed with a developer containing color image-forming couplers.

Specific examples of these cyan, magenta and yellow couplers which can be used in this invention are described in *Research Disclosure,* No. 17643, Item VII-D (Dec. 1978), and ibid, No. 18717 (Nov. 1979).

Also, couplers from which dyes having moderate diffusibility are produced, colorless couplers, DIR couplers capable of releasing a development inhibitor with the progress of the coupling reaction, or couplers capable of releasing a development accelerator with the progress of the coupling reaction can be used.

Representative yellow couplers that can be used in this invention are the oil-protected acylacetamido type couplers.

In this invention, two-equivalent yellow couplers are preferred to four-equivalent ones. Typical examples of two-equivalent couplers include those which have a splitting-off group attached to the coupling active site via its oxygen atom, and those of the type which have a splitting-off group attached to the coupling active site via its nitrogen atom. Among these yellow couplers, α-pivaloylacetoanilide couplers are of an advantage in that the dyes produced from them are excellent in fastness, especially to light, and α-benzoylacetoanilide couplers have an advantage in that they can ensure high color density to the developed image.

Magenta couplers which can be employed in this invention include those of oil-protected the indazolone type, the cyanoacetyl type, and preferably the 5-pyrazolone type and the pyrazoloazole type such as the pyrazolotriazole type. Among the couplers of the 5-pyrazolone type, those substituted by an arylamino or acylamino group at the 3-position are preferred over others from the viewpoint of the hue and color density of dye image developed.

Most suitable splitting-off groups for two-equivalent 5-pyrazolone couplers include those attached to the coupling active site via their nitrogen atom, as described in U.S. Pat. No. 4,310,619, and arylthio groups described in U.S. Pat. No. 4,351,897. In addition, ballast group-containing 5-pyrazolone couplers described in European Patent 73,636 can provide a high color density to the dye image developed.

Magenta couplers of pyrazoloazole types include the pyrazolobenzimidazoles described in U.S. Pat. No. 3,379,899, and more preferably the pyrazolo(5,1-c)(1,2,4)triazoles described in U.S. Pat. No. 3,725,067, the pyrazolotetrazoles described in *Research Disclosure,* 24220 (Jun. 1984) and the pyrazolopyrazoles described in *Research Disclosure,* 24230 (Jun. 1984). Among these couplers, imidazo(1,2-b)pyrazoles described in European Patent 119,741 are more desirable from the standpoint that the developed dye images show small side-absorption in the yellow region and have high fastness to light. In particular, the pyrazolo(1,5-b)(1,2,4)triazoles described in European Patent 119,860 are preferred over others.

Cyan couplers which can be preferably used in this invention includes the oil-protected naphthol type and phenol type couplers. Representatives of such naphthol couplers are those disclosed in U.S. Pat. No. 2,474,293. More preferable are the two-equivalent naphthol couplers of the type which have a splitting-off group attached to the coupling active site via its oxygen atom, as disclosed in U.S. Pat. Nos. 4,052,212, 4,146,396, 4,228,233 and 4,296,200. Specific examples of phenol type couplers are disclosed, e.g., in U.S. Pat. Nos. 2,369,929, 2,801,171, 2,772,162 and 2,895,826. Cyan couplers fast to moisture and heat are preferably employed in this invention. Typical examples of such cyan couplers are the phenol types which have an ethyl or higher alkyl group at the meta-position of the phenol nucleus (disclosed in U.S. Pat. No. 3,772,002); 2,5-diacylamino-substituted phenol type couplers; and phenol type couplers having a phenylureido group at the 2-position and an acylamino group at the 5-position.

For the purpose of compensating unnecessary absorptions in a short wavelength region in which the dyes produced from magenta and cyan couplers show, it is desirable that such couplers be used together with colored couplers in a color photographic material.

Graininess can be improved by the combined use of couplers that produce dyes of moderate diffusibility. As for the dye diffusion couplers, examples of magenta couplers are described in U.S. Pat. No. 4,366,237 and British Patent 2,125,570; examples of yellow, magenta, and cyan couplers are described in European Patent 96,570, and West German Patent Application (OLS) 3,234,533.

Dye-forming couplers and the above-cited special couplers may take a polymerized form (including a dimerized form). Typical examples of polymerized dye-forming couplers are described in U.S. Pat. Nos. 3,451,820 and 4,080,211. Specific examples of polymerized magenta coupler are disclosed in British Patent 2,102,173, and U.S. Pat. No. 4,367,282.

In order to realize the characteristics required of the photographic material, two or more couplers chosen from various kinds of couplers can be incorporated together in one light-sensitive emulsion layer, or one coupler can be incorporated in two or more different layers.

A standard amount of a color coupler used ranges from 0.001 to 1 mole per mole of light-sensitive silver halide. More specifically, a preferred amount is within the range of 0.01 to 0.5 mole in the case of yellow coupler 0.003 to 0.3 mole in the case of magenta coupler; and 0.002 to 0.3 mole in the case of cyan coupler.

In this invention, a developing agent, such as the hydroxybenzenes (e.g. hydroquinones), the aminophenols, the 3-pyrazolidones, may be added to an emulsion, or incorporated in the photographic material.

When associated with dye image-providing compounds (color materials), that can release a diffusible dye during the development of silver halide for the color diffusion transfer process, and subjected to appropriate development-processing, the photographic emulsions used in this invention can be used for the formation of desired transfer images in an image-receiving layer. As for the color materials for the color diffusion transfer process, a great many compounds are known. Those preferred in particular are color materials that are nondiffusible (immobile) by nature, but come to release a diffusible dye through the cleavage caused by a redox reaction with the oxidation product of a developing agent (or an electron-transfer agent) (hereinafter "DRR compounds").

Among the DRR compounds, those having an N-substitution sulfamoyl group are favored over others. In combined use with the nucleating agent of this invention, DRR compounds containing an o-hydroxyarylsulfamoyl group, as disclosed, e.g., in U.S. Pat. Nos. 4,055,428, 4,053,312 and 4,336,322; and DRR compounds having such a redox nucleus as disclosed in JP-A 53-149328 are particularly favored. When these DRR compounds are used in combination with the nucleating agent, the temperature dependence during the processing can be reduced markedly.

Direct positive color image formation using the photographic material of this invention is preferably carried out in the following manner: After imagewise exposure, the photographic material is subjected to color development with a surface developer, which contains an aromatic primary amine type color developing agent and is adjusted to pH 11.5 or less. Simultaneous with or subsequent to development is a fogging treatment with light or a nucleating agent. This is followed by bleach-fix processing. The pH value of this developer is preferably within the range of 11.0 to 10.0.

The fogging treatment in this invention may be carried out using either a so-called "photo-fogging method", wherein the light-sensitive layer is subjected to the second exposure over the whole surface thereof, or a so-called "chemical fogging method", wherein the development processing is carried out in the presence of a nucleating agent. Also, the development processing may be carried out in the presence of both fogging light and a nucleating agent, or the light-sensitive material in which a nucleating agent is incorporated is subjected to fogging exposure.

Details of the photo-fogging method is described in JP-A-63-108336. In particular, the nucleating agents represented by the general formulae (N-1) and (N-2) therein can be used to advantage. More specifically, the compounds described, ihid., as specific examples (N-I-1) to (N-I-10), and the compounds described as specific examples (N-II-1) to (N-II-12) are used to greater advantage.

Nucleation accelerating agents usable in this invention include those described ibid.. In particular, the compounds described therein as specific examples (A-1) to (A-13) are used to advantage.

Color developers usable for the development-processing of the light-sensitive material of this invention include those described ibid. (from the 4th line on page 71 to the 9th line on page 72).

For the aromatic primary amine color developing agent, p-phenylenediamine compounds are preferred. Typical examples of these include 3-methyl-4-amino-N-ethyl-N-(β-methanesulfonamidoethyl)aniline, 3-methyl-4-amino-N-ethyl-N-(β-hydroxyethyl)aniline, 3-methyl-4-amino-N-ethyl-N-methoxyethylaniline, and the sulfates, hydrochlorides or other salts of these anilines.

In forming a direct positive color image using the light sensitive material of this invention in accordance with the color diffusion transfer method, black and white developers such as phenidone derivatives can be used in addition to the above-described color developing agents.

After color development, photographic emulsion layers are generally subjected to a bleach processing. The bleach processing may be carried out simultaneously with a fixation processing (using a combined bleaching and fixing bath), or separately from them. For the purpose of speeding up the photographic processing, the bleach processing may be succeeded by a bleach-fix processing. The fixation processing may also be succeeded by a bleach-fix processing. In the bleaching bath or the bleach fix bath of this invention, iron complex salts of aminopolycarboxylic acids are generally used as the bleaching agent. Additives usable in the bleaching bath or the bleach-fix bath of this invention, are, for example, the wide variety of compounds described in JP-A-62-215272. After the desilvering step (bleach-fix or fixation step), the silver halide color photographic material of this invention is subjected to a washing step and/or a stabilizing step. In a washing bath or a stabilizing bath, water which has received a water softening treatment is preferably used. Examples of methods for softening water, are the method of using an ion exchange resin and the method of using an inverted permeation apparatus, as disclosed in JP-A-62-288838. It is desirable that these steps be carried out in accordance with the methods described in JP-A-62-288838.

Additives usable in the washing and stabilizing steps are, for example, the various compounds described in JP-A-62-215272.

It is desired that the replenisher for each processing step be used in the smallest possible amount. A preferred amount of replenisher used in each step is from one-tenth to 50 times, preferably from 3 to 30 times the amount of processing solution used per unit area of light-sensitive material.

Unless otherwise indicated herein, all parts, percents, ratios and the like are by weight.

EXAMPLE 1

Preparation of Light-Sensitive Emulsion

To an aqueous solution of gelatin kept at 50° C., an aqueous solution of silver nitrate and an aqueous solution of potassium iodide and potassium bromide were added at the same time over a 60-minute period in the presence of $4\times10^{-7}$ mol/mol Ag of potassium hexachloroiridate(III) and ammonia. During the course of the addition, the pAg of the reaction system was kept at 7.8. Thus, a monodisperse cubic silver iodobromide emulsion having an average grain size of 0.28 micron and an average iodide content of 0.3 mol % were prepared. This emulsion was desalted using the flocculation process, and thereto was added inert gelatin in an amount of 40 g per mole of silver. Thereafter, the emulsion was kept at 50° C. To it were added 5,5'-dichloro-9-ethyl-3,3'-bis(3-sulfopropyl)oxacarbocyanine as a sensitizing dye and $10^{-3}$ mol/mol Ag of a KI solution. After a lapse of 15 minutes, the temperature of the emulsion was lowered to 10° C.

Coating of Light-Sensitive Emulsion Layer

The obtained emulsion was dissolved again, and kept at 40° C. To it were added the hydrazine derivatives of the following formulae in the amounts set forth below:

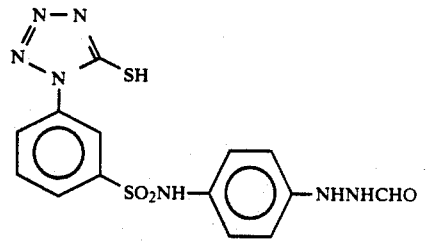

0.9 mg/m²

-continued

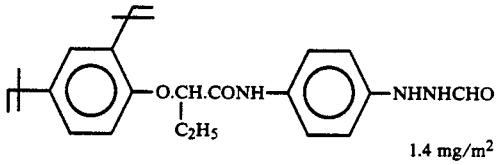

1.4 mg/m²

Also added were one of the redox compounds as set forth specifically in Table 1; 5-methylbenzotriazole, 4-hydroxy-1,3,3a,7-tetraazaindene, polyethylacrylate in a proportion of 30 wt % to the gelatin; and the compound illustrated below as a hardener:

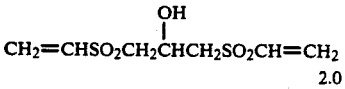

2.0 wt % to gelatin

The resulting emulsion was coated on a polyethylene terephthalate film (150 microns) having a subbing layer (0.5 micron) of a vinylidene chloride copolymer so as to have a silver coverage of 3.8 g/m².

Coating of Protective Layer

On this emulsion layer were coated gelatin, polymethylmethacrylate particles (an average particle size: 2.5 microns) and fine-grained AgCl (grain size: 0.08 miron) so as to have coverages of 1.5 g/m², 0.3 g/m² and 0.3 g/m² (based on silver), respectively, with the aid of the following surface active agents.

| Surface Active Agents | |
|---|---|
| 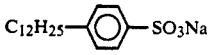 | 37 mg/m² |
| $CH_2COOC_6H_{13}$<br>\|<br>$CHCOOC_6H_{13}$<br>\|<br>$SO_3Na$ | 37 mg/m² |
| $C_8H_{17}SO_2N(C_3H_7)CH_2COOK$ | 2.5 mg/m² |

Evaluation of Properties

The thus prepared samples were exposed to tungsten light of 3200° K. through an optical wedge and a contact screen (150L chain-dot type, produced by Fuji Photo Film Co., Ltd.), developed with each of the developers described in Table 2 at 34° C. for 30 seconds, and then fixed, washed and dried.

Halftone dot qualities of these samples and dot gradation data are shown in Table 3.

(G):A gradient of the straight line connecting the point of density 0.3 and the point of density 3.0 on the characteristic curve of each sample. This value is proportional to contrast: the greater it is, the higher the contrast.

The screen range is represented by the following equation:

$$\text{Dot Gradation } (\Delta \log E) = [\text{Exposure which gives rise to a dot area rate of 95\% } (\log E_{95\%})] - [\text{Exposure which gives rise to a dot area rate of 5\% } (\log E_{5\%})]$$

The halftone dot quality was evaluated in five grades by observation with the naked eye. In the five-grade evaluation, "5" represents the best quality, and "1" represents the worst quality. The grades "5" and "4" are practically usable as a halftone original for graphic arts. The grade "3" is barely usable level. The grades "2" and "1" are not usable.

TABLE 1

| Sample Name | Redox Compound Kind | Redox Compound Amount added (mol/mol Ag) |
|---|---|---|
| Comparative Sample-1 | — | — |
| Invention 1 | III-17 | $5.7 \times 10^{-4}$ |
| 2 | III-18 | " |
| 3 | III-41 | " |
| 4 | III-19 | " |
| 5 | III-27 | " |
| 6 | III-35 | " |
| 7 | III-42 | $8.6 \times 10^{-5}$ |
| 8 | III-45 | " |

TABLE 2

| | Formulations of Developers | | | | |
|---|---|---|---|---|---|
| | Comparative Developer | Invention Developer-I | Invention Developer-II | Invention Developer-III | Invention Developer-IV |
| Hydroquinone | 50.0 g | 50.0 g | 50.0 g | 50.0 g | 50.0 g |
| N-Methyl-p-aminophenol | 0.3 g | 0.3 g | 0.3 g | 0.3 g | 0.3 g |
| Sodium hydroxide | 18.0 g | 18.0 g | 18.0 g | 18.0 g | 18.0 g |
| 5-Sulfosalicylic acid | 55.0 g | 55.0 g | 55.0 g | 55.0 g | 55.0 g |
| Potassium sulfite | 110.0 g | 110.0 g | 110.0 g | 110.0 g | 110.0 g |
| Disodium ethylenediaminetetraacetate | 1.0 g | 1.0 g | 1.0 g | 1.0 g | 1.0 g |
| Potassium bromide | 10.0 g | 10.0 g | 10.0 g | 10.0 g | 10.0 g |
| 5-Methylbenzotriazole | 0.4 g | 0.4 g | 0.4 g | 0.4 g | 0.4 g |
| 2-Mercaptobenzimidazole-5-sulfonic acid | 0.3 g | 0.3 g | 0.3 g | 0.3 g | 0.3 g |
| Sodium 3-(5-mercaptotetrazoyl)benzenesulfonate | 0.2 g | 0.2 g | 0.2 g | 0.2 g | 0.2 g |
| N-n-butyldiethanolamine | 15.0 g | — | — | — | — |
| Accelerator | — | Compound (II-21) 4.0 g | Compound (II-24) 4.5 g | Compound (II-22) 3.0 g | Compound (II-23) 4.0 g |
| Sodium toluenesulfonate | 8.0 g | 8.0 g | 8.0 g | 8.0 g | 8.0 g |
| Water to make | 1 l | 1 l | / 1 l | 1 l | 1 l |
| pH adjusted (with KOH) to | 11.5 | 11.5 | 11.5 | 11.5 | 11.5 |

TABLE 3

| Sample Name | Developer | Photographic Characteristics $\bar{G}$ | DOT Gradation | Halftone Dot Quality | Note |
|---|---|---|---|---|---|
| Comparative Sample-1 | Comparative Developer | 15.0 | 1.21 | 3 | Comparison |
| " | Developer- I | 15.3 | 1.18 | 3 | " |
| " | II | 15.1 | 1.19 | 3 | " |
| " | III | 14.8 | 1.21 | 3 | " |
| " | IV | 14.7 | 1.23 | 3 | " |
| Invention 1 | Comparative Developer | 9.5 | 1.38 | 3 | " |
| 2 | " | 9.0 | 1.36 | 3 | " |
| 3 | " | 9.6 | 1.35 | 3 | " |
| Invention 1 | Developer- I | 15.0 | 1.42 | 5 | Invention |
| " | II | 14.8 | 1.40 | 5 | " |
| " | III | 13.7 | 1.38 | 4 | " |
| " | IV | 13.5 | 1.39 | 4 | " |
| Invention 2 | Developer-I | 15.1 | 1.41 | 5 | " |
| 3 | " | 14.8 | 1.40 | 5 | " |
| Invention 4 | Developer-I | 14.0 | 1.41 | 5 | Invention |
| 5 | " | 13.3 | 1.38 | 5 | " |
| 6 | " | 14.1 | 1.40 | 5 | " |
| 7 | " | 12.3 | 1.39 | 5 | " |
| 8 | " | 14.4 | 1.37 | 5 | " |
| 2 | Developer-II | 15.3 | 1.36 | 5 | " |
| 3 | " | 15.0 | 1.33 | 5 | " |
| 4 | " | 14.8 | 1.38 | 5 | " |
| 5 | " | 13.6 | 1.40 | 5 | " |
| 6 | Developer-III | 15.2 | 1.37 | 4 | " |
| 7 | " | 14.7 | 1.37 | 4 | " |
| 8 | " | 14.4 | 1.38 | 4 | " |
| 2 | Developer IV | 13.9 | 1.40 | 4 | " |
| 3 | " | 14.1 | 1.39 | 4 | " |

As can be seen from the data of Table 3, every example performed in accordance with an embodiment of this invention was superior in all aspects, including contrast, dot gradation and halftone dot quality.

EXAMPLE 2

To an aqueous solution of gelatin kept at 50° C., an aqueous solution of silver nitrate and an aqueous solution of sodium chloride were added at the same time in the presence of $5.0\times10^{-6}$ mol/mol Ag of ammonium hexachlororhodate(III). After soluble salts were removed using a method well-known to one skilled in the arts, gelatin was added to the resulting emulsion. Further, 2-methyl-4-hydroxy-1,3,3a,7-tetraazaindene was added as stabilizer without subjecting the emulsion to chemical ripening. Thus, a monodisperse cubic silver chloride emulsion having an average grain size of 0.15 micron was obtained. To it were added the following hydrazine compound;

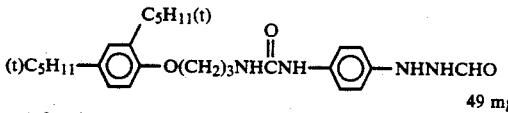

49 mg/m² and further, one of the redox compounds of this invention set forth specifically in Table 4, a polyethylacrylate latex in a proportion of 30 wt % to the gelatin on a solids basis, and 1,3-vinylsulfonyl-2-propanol as a hardener. The thus prepared emulsion was coated on a polyester support so as to have a silver coverage of 3.8 g/m². On this emulsion layer were coated a protective layer containing 1.5 g/m² of gelatin; 0.3 g/m² of polymethylmethacrylate particles (an average particle size: 2.5 microns); and the following surface active agents, stabilizer and ultraviolet absorbing dye. These coatings were then dried.

Surface Active Agents

-continued

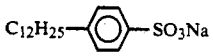

37 mg/m²

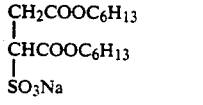

37 mg/m²

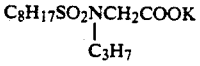

2.5 mg/m²

Stabilizer

Thioctic acid 2.1 mg/m²

Ultraviolet Absorbing Dye

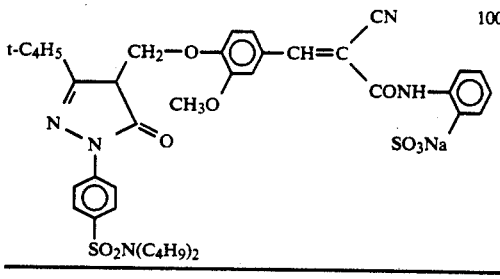

100 mg/m²

Each of these samples was exposed imagewise through originals as shown in FIG. 1 by means of a daylight printer P-607, made by Dainippon Screen Mfg. Co., Ltd., and subjected succesixely at 38° C. to 20 seconds of development, fixation, washing and drying. The white-on-black letter image qualities of the processed samples were then evaluated.

The same comparative developer and Developers I to IV used in Example 1 were employed in this example, too.

The quality "5" of white-on-black letter images means that when the originals and a photosensitive material for contact work were arranged as illustrated in FIG. 1, and exposed to reproduce 50% dot area of the halftone original as 50% dot area on the contact photosensitive material, letters having a line width of 30 microns could be reproduced on the contact photosensitive material. On the other hand, the quality "1" of white-on-black letter images means that letters having a line width of 150 microns or more could barely be reproduced. Three grades 4, 3 and 2 were made between the quality "5" and the quality "1" on a basis of organoleptic evaluation. The grades lower than 3 were practically useless.

The results obtained are shown in Table 4. It can be seen from the data in Table 4 that the combined use of the photographic material of this invention and the developer of this invention effected a remarkable improvement in image quality.

TABLE 4

| Name of Photosensitive Material | | Redox Compound Kind | Redox Compound Amount Added (mol/mol Ag) | Developer | Quality of White-on-Black Letter Image | Note |
|---|---|---|---|---|---|---|
| Comparative Sample | 2-1 | — | — | Comparative Developer | 2.5 | Comparison |
| Invention Sample | 2-1 | III-17 | $1.4 \times 10^{-3}$ | " | 3.5 | " |
| | 2-2 | III-38 | $1.4 \times 10^{-3}$ | " | 3.5 | " |
| Comparative Sample | 2-1 | — | — | Developer-I | 2.5 | " |
| Invention Sample | 2-1 | III-17 | $1.4 \times 10^{-3}$ | " | 4.5 | Invention |
| | 2-2 | III-38 | $1.4 \times 10^{-3}$ | " | 4.5 | " |
| | 2-3 | III-41 | $1.4 \times 10^{-3}$ | Developer II | 4.5 | " |
| | 2-4 | III-19 | $1.4 \times 10^{-3}$ | Developer-III | 4.0 | " |
| | 2-5 | III-27 | $1.4 \times 10^{-3}$ | Developer-IV | 4.0 | " |
| | 2-6 | III-42 | $1.4 \times 10^{-3}$ | Developer-I | 4.5 | " |
| | 2-7 | III-45 | $1.4 \times 10^{-3}$ | " | 4.5 | " |

While the invention has been described in detail and with reference to specific embodiments, it will be apparent to one skilled in the art that various changes and modifications can be made to the described invention without departing from its spirit and scope.

What is claimed is:

1. A method for forming a negative image comprising the steps of:

(a) imagewise exposing a silver halide photographic material; where said photographic material contains:

(1) a compound represented by formula (I)

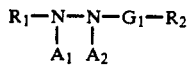

(I)

wherein $R_1$ represents an aliphatic group or an aromatic group;

$R_2$ represents a hydrogen atom, an alkyl group, an aryl group, an alkoxy group, an aryloxy group, an amino group, a carbamoyl group, or an oxycarbonyl group;

$G_1$ represents a carbonyl group, a sulfonyl group a sulfoxy group, a

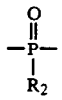

group, or an iminomethylene group; and $A_1$ and $A_2$ both represent a hydrogen atom, or one of $A_1$ and $A_2$ represents a hydrogen atom and the other represents a substituted or unsubstituted alkylsulfonyl group, a substituted or unsubstituted arylsulfonyl group, or a substituted or unsubstituted acyl group, and (2) a redox compound that can release a development inhibitor when oxidized and which is represented by formula (III):

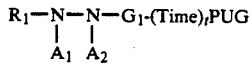

(III)

wherein $R_1$, $A_1$, $A_2$ and $G_1$ have the same meanings as in the foregoing general formula (I), respectively;

Time represents a divalent linkage group;

t represents 0 or 1; and

PUG represents a development inhibitor; and (b) subjecting said imagewise exposed silver halide photographic materials to development-processing where a bath used in said development-processing contains a nucleation development accelerator represented by formula (II):

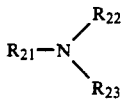

(II)

wherein $R_{21}$, $R_{22}$ and $R_{23}$ each represents a substituted or unsubstituted alkyl group selected so as to satisfy the requirement that the sum of the logarithmic values (log P) of the n-octanol/water partition coefficients of H—$R_{21}$, H—$R_{22}$ and H—$R_{23}$ is from 2.6 to less than 10.0.

2. The negative image forming method of claim 1, wherein the sum of the log P is from 3.0 to less than 8.0.

3. The negative image forming method of claim 1, wherein the sum of the log P is from 3.0 to less than 4.48.

* * * * *